US006548239B2

(12) United States Patent
Goto

(10) Patent No.: US 6,548,239 B2
(45) Date of Patent: Apr. 15, 2003

(54) PHOTOTHERMOGRAPHIC MATERIAL

(75) Inventor: Takahiro Goto, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/827,165

(22) Filed: Apr. 6, 2001

(65) Prior Publication Data

US 2002/0081542 A1 Jun. 27, 2002

(30) Foreign Application Priority Data

Apr. 7, 2000 (JP) ..... 2000-105948

(51) Int. Cl.[7] ..... G03C 1/498; G03C 1/20

(52) U.S. Cl. ..... 430/619; 430/584; 430/588; 430/613; 430/614; 430/615

(58) Field of Search ..... 430/619, 613, 430/614, 615, 584, 588

(56) References Cited

U.S. PATENT DOCUMENTS 5,258,282 A * 11/1993 Kagami et al. ..... 430/619
5,876,915 A * 3/1999 Deroover et al. ..... 430/619
5,962,211 A * 10/1999 Maronian et al. ..... 430/584
5,981,161 A * 11/1999 Hosoi ..... 430/567
6,040,131 A * 3/2000 Eshelman et al. ..... 430/619
6,120,982 A * 9/2000 Parton et al. ..... 430/584

FOREIGN PATENT DOCUMENTS

JP 5265121 10/1993

* cited by examiner

*Primary Examiner*—Thorl Chea
(74) *Attorney, Agent, or Firm*—Birch, Stewart, Kolasch & Birch, LLP

(57) ABSTRACT

Disclosed is a photothermographic material containing a non-photosensitive silver salt and a photosensitive silver halide on a support, wherein the photosensitive silver halide is spectrally sensitized with a spectral sensitizing dye so that maximum spectral sensitivity wavelength could become longer than 730 nm and the conditions defined by the following formulas (1) and (2) and/or the conditions defined by the following formulas (3) and (4) could be satisfied:

$$300 \geqq S(\lambda\ \max)/S(\lambda\ \max+30\ nm) \geqq 4.5 \quad \text{Formula (1)}$$

$$30 \geqq S(\lambda\ \max)/S(\lambda\ \max-30\ nm) \geqq 2 \quad \text{Formula (2)}$$

$$300 \geqq Abs.(\lambda\ \max)/Abs.(\lambda\ \max-30\ nm) \geqq 4.5 \quad \text{Formula (3)}$$

$$30 \geqq Abs.(\lambda\ \max)/Abs.(\lambda\ \max-30\ nm) \geqq 2 \quad \text{Formula (4)}$$

wherein, in the above formulas, λmax denotes maximum spectral sensitivity wavelength, Abs.(λ) denotes optical density at a wavelength of λ and S(λ) denotes spectral sensitivity at a wavelength of λ. The photothermographic material of the present invention can form images with low fog and shows little increase of fog and sensitivity fluctuation during storage before light exposure.

22 Claims, 1 Drawing Sheet

PHOTOTHERMOGRAPHIC MATERIAL

FIELD OF THE INVENTION

The present invention relates to a photothermographic material. In particular, the present invention relates to a photothermographic material for scanners, image setters and so forth, which is particularly suitable for photographic art. More precisely, the present invention relates to a photothermographic material suitable for infrared semiconductor lasers.

RELATED ART

There are known many photosensitive materials having a photosensitive layer on a support, with which image formation is attained by imagewise light exposure. These materials include those utilizing a technique of forming images by heat development as systems that can contribute to the environmental protection and simplify image-forming means.

In recent years, reduction of amount of waste processing solutions is strongly desired in the field of photographic art from the standpoints of environmental protection and space savings. Therefore, development of techniques relating to photothermographic materials for photographic art is required, which materials enable efficient exposure by a laser scanner or laser image setter and formation of clear black images having high resolution and sharpness. Such photothermographic materials can provide users with simpler and non-polluting heat development processing systems that eliminate the use of solution-type processing chemicals.

Methods for forming images by heat development are described in, for example, U.S. Pat. Nos. 3,152,904 and 3,457,075 and D. Klosterboer, "Thermally Processed Silver Systems A", Imaging Processes and Materials, Neblette, 8th ed., compiled by J. Sturge, V. Walworth and A. Shepp, Chapter 9, p.279, (1989). Such photothermographic materials comprise a reducible non-photosensitive silver source (e.g., silver salt of an organic acid), a photocatalyst (e.g., silver halide) in a catalytically active amount and a reducing agent for silver, which are usually dispersed in an organic binder matrix. While the photosensitive materials are stable at an ordinary temperature, when they are heated to a high temperature (e.g., 80° C. or higher) after light exposure, silver is produced through an oxidation-reduction reaction between the reducible silver source (which functions as an oxidizing agent) and the reducing agent. The oxidation-reduction reaction is accelerated by catalytic action of a latent image generated upon exposure. The silver produced from the reaction of the reducible silver salt in the exposed areas shows black color and provides contrast with respect to the non-exposed areas, and thus images are formed.

In many of conventionally known photothermographic materials, image-forming layers are formed by coating a coating solution using an organic solvent such as toluene, methyl ethyl ketone (MEN) and methanol as a solvent. However, not only use of an organic solvent as a solvent adversely affect human bodies during the production process, but also it is disadvantageous in view of cost because it requires process steps for recovery of the solvent and so forth.

Accordingly, methods of forming an image-forming layer by coating a coating solution using water as a solvent have been proposed. For example, Japanese Patent Laid-open Publication (Kokai, hereinafter referred to as JP-A) 49-52626, JP-A-53-116144 and so forth disclose image-forming layers utilizing gelatin as a binder, and JP-A-50-151138 discloses an image-forming layer utilizing polyvinyl alcohol as a binder. Furthermore, JP-A-60-61747 discloses an image-forming layer utilizing gelatin and polyvinyl alcohol in combination. As another example, JP-A-58-28737 discloses an image-forming layer utilizing a water-soluble polyvinyl acetal as a binder. If these binders are used, image-forming layers can be formed by using a coating solution comprising an aqueous solvent, and therefore considerable merits can be obtained with respect to environment and cost.

However, when a polymer such as gelatin, polyvinyl alcohol or water-soluble polyacetal is used as a binder, silver tone of developed areas becomes brown or yellow, which quite differs from black color regarded as a preferred proper color, and in addition, there arise, for example, problems that the blacking density in exposed areas becomes low and the density in unexposed areas becomes high. Thus, there can be obtained only images of which commercial value is seriously impaired. Furthermore, since such polymers show bad compatibility with the silver salt of an organic acid, there may also arise a problem that practically acceptable coatings cannot be obtained in view of coated surface quality.

European Patent Publication (hereinafter referred to as EP-A) 762196, JP-A-9-90550 and so forth disclose that high-contrast photographic property can be obtained by incorporating Group VII or VIII metal ions or metal complex ions thereof into photosensitive silver halide grains for use in photothermographic materials, or incorporating a hydrazine derivative into the photosensitive materials.

Meanwhile, photosensitive materials for platemaking are used as intermediate materials in printing process, i.e., as masks for producing printing plates. In recent years, digitization and automation of operations have been widely diffused for the whole printing process, and light exposure and development of PS plates in the platemaking process are automated by the use of platemaking machines. Such platemaking machines serve as systems that operate when information required for automatic transportation, automatic light exposure and so forth (bar code or register mark) written on photothermographic materials is read by sensors of the platemaking machines. These sensors utilize laser diodes of a wavelength around 670 nm. That is, it is indispensable that the information written on the photothermographic materials can be read at a wavelength of 670 nm, and it is preferred that the photothermographic materials should show low Dmin (minimum density) at a wavelength of around 670 nm. In particular, it is preferable to use an antihalation dye showing low absorption in the visible region.

As for photothermographic materials that are designed to be subjected to infrared light exposure, absorption in the visible region of sensitizing dye or antihalation dye can be significantly reduced, and thus substantially colorless photothermographic materials can easily be produced. Further, semiconductor lasers have been widely used in recent years, and silver halide photosensitive materials for infrared sensitization have become to be used more frequently.

Since laser lights including those of semiconductor lasers show specific emission wavelengths, it is sufficient to strongly sensitize only the characteristic wavelength corresponding to the oscillation wavelengths of lasers. In other wards, in not a few cases, it is rather preferred that sensitivity for the wavelength regions other than the laser oscillation wavelength should be as low as possible in view of safe light safety and so forth. A technique for sensitizing only for a specific wavelength for that purpose is known as J-band sensitization among the spectral sensitization techniques for silver halide photosensitive emulsions. J-band is obtained by formation of particular aggregates called J-aggregates, and shows extremely sharp absorption with extremely strong absorbance and extremely narrow half-width. Reflecting this absorption characteristic, spectral sensitivity also shows a sharp spectral sensitivity distribution spectrum. Many examples of this J-band sensitization are known for visible region and it is an indispensable spectral sensitization technique for the production of full color photosensitive materials, for example, However, examples thereof for the infrared regions are extremely scarce, and only brief explanations are found in A. H. Henry, Photogr. Sci. Eng., vol. 18 (No. 3), pp.323–335, (1974) and H. Rampfer, ICPs Reports, pp.366–369 (1986). Further, examples thereof for photothermographic materials are also scarce.

In infrared sensitization systems showing a sensitization peak at a wavelength longer than 730 nm, on the other hand, an increased addition amount of sensitizing dyes provides strong desensitization (described in U.S. Pat. No. 4,011,083 etc.). This desensitization is well known as proper desensitization provided by sensitizing dyes, and it is also known to become stronger with a dye showing absorption at a longer wavelength. Because such sensitizing dyes for infrared region as mentioned above show extremely strong desensitization of such a kind, the coating ratio of the dyes on the silver halide grain surfaces must be generally around 10–20%. Therefore, the light capturing ratio inevitably becomes low, and spectral sensitivity to be obtained is much lower than the spectral sensitivity imparted for the visible region. Thus, spectral sensitivity distribution obtained in such a state becomes very broad one based on the absorption of the dyes in molecular state. Furthermore, although the aforementioned literature mentions formation of J-band, that spectral sensitization is assumed to consist of both of M-band type spectral sensitization based on molecules of sensitizing dye in the molecular state and J-band type spectral sensitization based on J-aggregates of sensitizing dye, because it is described that an extremely broad spectral sensitivity distribution was obtained with silver chlorobromide emulsion mainly consisting of silver iodobromide and silver bromide. Further, because laser light exposure, handling under a safe light, adaptation to full color photosensitive material and so forth were not well taken into consideration, it was not intended to suppress sensitivity for the unnecessary regions. Therefore, although J-band sensitization was obtained in any case, it was not realized as one mainly consisting of J-band type spectral sensitization with narrow spectral sensitization distribution, and thus it was extremely unsatisfactory one for practical use.

Therefore, there is desired a sensitization method that provides J-band sensitization with high spectral sensitivity suitable for an infrared region, in particular, wavelengths of semiconductor laser lights, and simultaneously provides low sensitivity for unnecessary regions. Further, if spectral sensitization is desired for a wavelength longer than 730 nm, a spectral sensitization dye that can efficiently absorb long wavelength lights must be used. Infrared sensitizing dyes are disclosed in JP-A-61-137149, JP-A-63-197947 and JP-A-55-13505 as well as JP-A-59-191032, JP-A-59-192242 and JP-A-60-80841 mentioned above and so forth, and there are used dyes having long conjugated methine chains in order to provide absorption in an infrared region. However, not only it is extremely difficult to form J-aggregates on silver halide grains with cyanine dyes having such long methane chains to predominantly provide J-band sensitization, but also dyes providing spectral sensitization by infrared absorption generally show high HONG and hence strong reducing ability, and thus they are likely to reduce silver ions in photothermographic materials to degrade fog of the photothermographic materials. In particular, during storage under high temperature and high humidity or storage for a long period of time, marked change of performance may be observed. Moreover, if a dye showing low HOMO is used in order to prevent the degradation of storability, LUMO also correspondingly becomes lower. Thus, spectral sensitization efficiency is reduced and hence sensitivity is lowered. These problems concerning sensitivity, storability and performance fluctuation are observed not only in wet type photosensitive materials, but also in photothermographic materials, in which the problems become more serious.

Therefore, there have been desired techniques for providing photothermographic materials that can provide images with low fog as well as little increase of fog and little sensitivity fluctuation during storage before light exposure, and are advantageous for environment and cost.

SUMMARY OF THE INVENTION

Therefore, in view of the aforementioned problems of the prior art, an object of the present invention is to provide a photothermographic material, in particular, for photographic art, especially for scanners and image setters, that can form images with low fog and show little increase of fog and little sensitivity fluctuation during storage before light exposure.

The inventors of the present invention assiduously studied in order to achieve the aforementioned object. As a result, they found that a superior photothermographic material could be obtained if spectral sensitization is performed so that spectral sensitivity or optical density in the range of maximum spectral sensitivity wavelength ±30 nm could satisfy particular conditions, and thus accomplished the present invention.

That is, the present invention provides a photothermographic material containing a non-photosensitive silver salt and a photosensitive silver halide on a support, wherein the photosensitive silver halide is spectrally sensitized with a spectral sensitizing dye so that maximum spectral sensitivity wavelength could become longer than 730 nm and the conditions defined by the following formulas (1) and (2) could be satisfied.

$$300 \geqq S(\lambda\ \max)/S(\lambda\ \max+30\ nm) \geqq 4.5 \qquad \text{Formula (1)}$$

$$30 \geqq S(\lambda\ \max)/S(\lambda\ \max-30\ nm) \geqq 2 \qquad \text{Formula (2)}$$

In the above formulas, λmax denotes maximum spectral sensitivity wavelength, and S(λ) denotes spectral sensitivity at a wavelength of λ.

The present invention also provides a photothermographic material containing a non-photosensitive silver salt and a photosensitive silver halide on a support, wherein the photosensitive silver halide is spectrally sensitized with a spectral sensitizing dye so that maximum spectral sensitivity wavelength could become longer than 730 nm and the conditions defined by the following formulas (3) and (4) could be satisfied.

$$300 \geqq Abs.(\lambda\ \max)/Abs.(\lambda\ \max+30\ nm) \geqq 4.5 \qquad \text{Formula (3)}$$

$$30 \geqq Abs.(\lambda\ \max)/Abs.(\lambda\ \max-30\ nm) \geqq 2 \qquad \text{Formula (4)}$$

In the above formulas, λmax denotes is maximum spectral sensitivity wavelength, and Abs. (λ) denotes optical density at a wavelength of λ.

The photothermographic material of the present invention shows photographic properties suitable for photographic art, i.e., high sensitivity and little increase of fog and sensitivity fluctuation during long-term storage. Further, it can be prepared by coating an aqueous system, which is advantageous for environment and cost.

PREFERRED EMBODIMENT OF THE INVENTION

Figure 1:
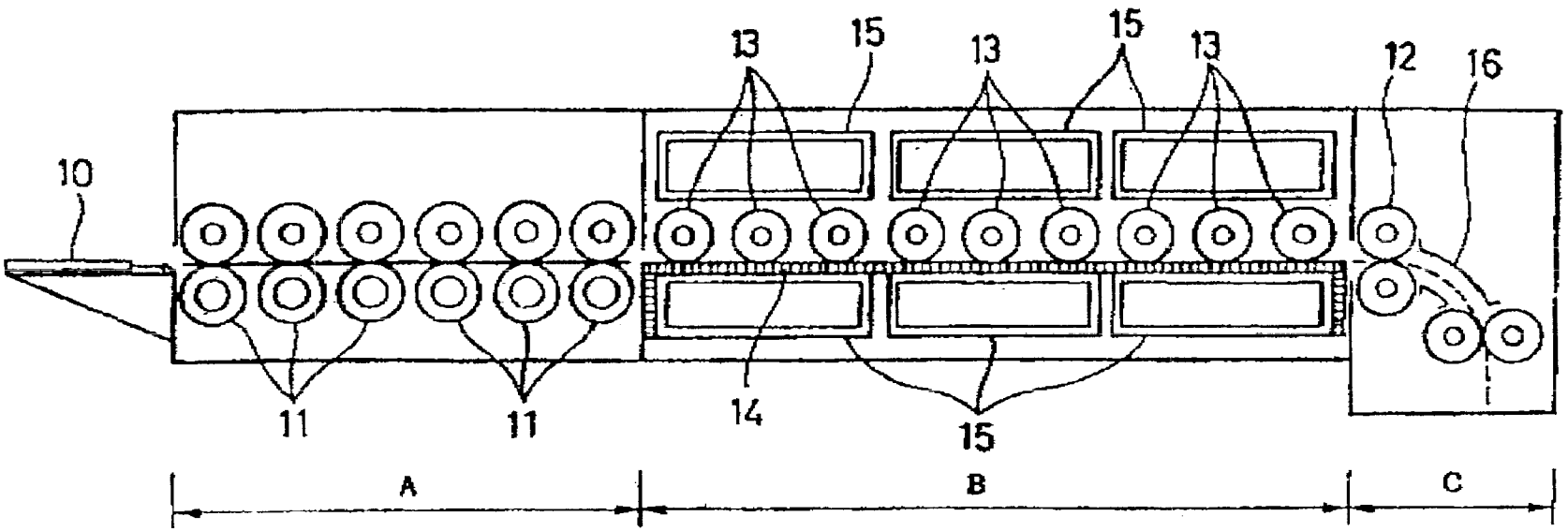
FIG. 1 is a side view of an exemplary heat developing apparatus used for heat development of the photothermographic material of the present invention. In the FIGURE, there are shown a photothermographic material 10, carrying-in roller pairs 11, carrying-out roller pairs 12, rollers 13, a flat surface 14, heaters 15, and guide panels 16. The apparatus consists of a preheating section A, a heat development section B, and a gradual cooling section C.

The photothermographic material of the present invention will be explained in detail hereafter.

The photothermographic material of the present invention contains a non-photosensitive silver salt and a photosensitive silver halide on a support. It is characterized in that the photosensitive silver halide is spectrally sensitized with a spectral sensitizing dye so that maximum spectral sensitivity wavelength could become longer than 730 nm and the sensitivity ratios defined by the aforementioned formulas (1) and (2) and/or the optical density ratios defined by the aforementioned formulas (3) and (4) could be satisfied.

By using the photothermographic, material of the present invention having the aforementioned characteristics, images can be obtained with low fog (Dmin), and increase of fog or decrease of sensitivity due to storage before light exposure can be prevented. Therefore, the photothermographic material of the present invention is extremely useful, in particular, for photographic art, especially for scanners and image setters. Further, since the photothermographic material of the present invention can be prepared with an aqueous coating solution utilizing a solvent (dispersion medium) mainly consisting of water, it is advantageous for environment and cost. In particular, polymer latex is preferably used as a main binder of image-forming layer side, because it enables coating with aqueous coating solution and provides good photographic performance.

Whether the sensitivity ratios defined by the formulas (1) and (2) are satisfied or not is determined by measuring spectral sensitivity at the maximum spectral sensitivity wavelength [S(λmax)], spectral sensitivity at a wavelength longer than the maximum spectral sensitivity wavelength by 30 nm [(λmax+30 nm)], and spectral sensitivity at a wavelength shorter than the maximum spectral sensitivity wavelength by 30 nm [S(λmax−30 nm)]. The measurement of the spectral sensitivity is performed for a coated film having a silver halide emulsion layer added with a spectral sensitizing dye, which is light-exposed through a wedge by using an isoenergetic spectral light exposure apparatus and developed. The sensitivity used herein is a reciprocal of exposure giving a density larger than fog (Dmin) density by 0.2.

The value of S(λmax)/S(λmax+30 nm) mentioned in the formula (1) must be 4.5–300, and it is preferably 5–200, particularly preferably 10–200. In the present specification, ranges indicated with "–" mean ranges including the numerical values before and after "–" as the minimum and maximum values.

The value of S(λmax)/S(λmax−30 nm) mentioned in the formula (2) must be 2–30, and it is preferably 2–20, particularly preferably 2–10.

Whether the optical density ratios (absorbance ratios) defined by the formulas (3) and (4) are satisfied or not is determined by measuring optical density at the maximum spectral sensitivity wavelength [Abs.(λmax)], optical density at a wavelength longer than the maximum spectral sensitivity wavelength by 30 nm λAbs. (λmax+30 nm), and optical density at a wavelength shorter than the maximum spectral sensitivity wavelength by 30 nm [Abs(λmax−30 nm)]. The optical density (absorbance) can be obtained by measurement for a coated film having a silver halide emulsion layer added with a spectral sensitizing dye using a spectrophotometer provided with an integral sphere (e.g., spectrophotometer Model U-3410 produced by Hitachi Co., Ltd).

The value of Abs.(λmax)/Abs.(λmax+30 nm) mentioned in the formula (3) must be 4.5–300, and it is preferably 5–200, particularly preferably 10–200.

The value of Abs.(λmax)/Abs.(λmax−30 nm) mentioned in the formula (4) must be 2–30, and it is preferably 2–20, particularly preferably 2–10.

If any of the values exceeds each of the maximum values defined in the formulas (1) to (4), influence of fluctuation of laser light source wavelength may become more significant, and thus sensitivity fluctuation unfavorably becomes more significant.

The main target of the present invention can be achieved if the maximum spectral sensitivity wavelength is longer than 730 nm, and the sensitivity ratios defined by the formula (1) and (2) and the optical density ratios defined by the formula (3) and (4) are satisfied. However, it is difficult to attain such sensitization that the above conditions should be satisfied only by adding a spectral sensitizing dye to the silver halide emulsion. Such spectral sensitization that the maximum spectral sensitivity wavelength should become longer than 730 nm and the sensitivity ratios defined by the formula (1) and (2) and the optical density ratios defined by the formula (3) and (4) should be satisfied can be attained by selecting the spectral sensitizing dye as described below, and properly using it.

For example, if the silver halide emulsion is added with a spectral sensitizing dye in an amount of $1\times10^{-7}$ mole (this amount corresponds to such an amount that almost 40% of silver halide grain surfaces should be coated, if it is assumed that the area occupied by one molecule of sensitizing dye is $10^6$ $A^2$ and all of the added sensitizing dye is adsorbed on silver halide grains as a monolayer) to $1\times10^{-2}$ mole, more preferably $5\times10^{-7}$ to $7\times10^{-4}$ mole, per 1 $m^2$ of surface area of the silver halide grains, at a temperature range of 40–90° C., more preferably 50–80° C., further preferably 60–70° C., and ripened, the aforementioned sensitivity ratios and/or optical density ratio may be satisfied.

As the spectral sensitizing dye used for the present invention, any dyes may be used so long as they satisfy the aforementioned sensitivity ratios and/or optical density ratios and have the maximum spectral sensitivity wavelength of 730 nm or longer. However, in order to provide a photothermographic material showing high sensitivity, in which decrease of photographic sensitivity for infrared region and increase of fog caused during storage of emulsion as a solution before coating and storage after coating are suppressed, which constitutes one of the objects of the present invention, a spectral sensitizing dye to be used desirably shows a polarographic half-wave reduction potential more negative than −1.26 V and a polarographic half-wave oxidation potential more positive than 0.38 V with respect to a saturated calomel electrode. As for the relationship between the polarographic half-wave reduction potential of spectral sensitizing dye and spectral sensitization efficiency, a more negative half-wave reduction potential provides better efficiency as described in, for example, T. Tani, T. Suzumoto, K. Ohzeki, Journal of Physical Chemistry, vol. 94, p.1298 (1990) etc. However, most of the conventional spectral sensitizing dyes providing spectral sensitization of molecular type such as those mentioned in the aforementioned patent documents concerning infrared sensitization provide a half-wave reduction potential in the range of −1.1 to −1.25 V vs SCE, which is not so negative. Therefore, the sensitization efficiency is currently much worse compared with the dyes for sensitization in visible region showing more negative half-wave reduction potentials. In the present invention, the infrared sensitization is realized by J-band sensitization, and as a result, it becomes possible to use even a sensitizing dye showing a half-wave reduction potential more negative than that providing high sensitization efficiency, i.e., more negative than −1.26 V vs SCE. Therefore, in order to further increase spectral sensitivity, the polarographic half-wave reduction potential of the sensitizing dye to be used is desirably more negative than −1.26 v vs SCE. On the other hand, the aforementioned conventionally used infrared sensitizing dyes of molecular type generally show an oxidation potential more negative than 0.45 V vs SCE. Most of them show the potential more negative than 0.40 V vs SCE, and those showing the potential more negative than 0.30 V vs SCE are not rare among them. These potentials are considerably more negative compared with those of the sensitizing dyes used for visible region. If the oxidation potential becomes more negative, the substance becomes more likely to be oxidized. Therefore, infrared photosensitive materials subjected to spectral sensitization using conventional sensitizing dyes of molecular type, which show such negative oxidation potentials, show marked sensitivity decrease during storage. The inventors of the present invention found that the stability during storage was markedly improved by performing the J-band sensitization using a sensitizing dye showing an oxidation potential more positive than 0.38 V. Therefore, in order to suppress the decrease of photographic sensitivity for infrared region and increase of fog for a photothermographic material, which are caused during storage of emulsion as a solution before coating and storage after coating, the polarographic half-wave oxidation potential of the sensitizing dye to be used is more desirably more positive than 0.38 V vs SCE. The polarographic half-wave potentials can be measured by the phase discrimination second harmonics AC voltammetry method described in T. Tani, K. ohzeki, K. Seki, Journal of the Electrochemical Society, vol. 138, pp.1411–1415 and J. Lenhard, Journal of Imaging Science, vol. 30, pp.27–35.

While any spectral sensitizing dyes that satisfy the aforementioned sensitivity ratios and/or the absorbance ratios and show a maximum sensitization wavelength of 730 nm or longer can be utilized as the spectral sensitizing dye used for the present invention, compounds represented by the general formula (I) are particularly useful.

Formula (I)

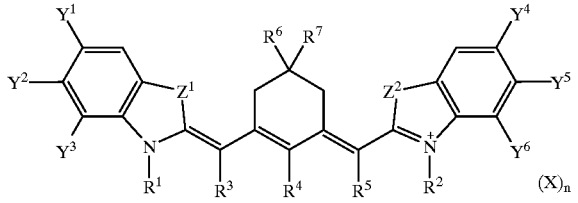

In the formula, $Z^1$ and $Z^2$ may be the same or different from each other, and they represent sulfur atom or selenium atom. $Y^1$ and $Y^4$ represent hydrogen atom, and $Y^1$, when $Y^2$ is not hydrogen atom, and $Y^4$, when $Y^5$ is not hydrogen atom, also represent methyl group, ethyl group, hydroxy group or methoxy group. $Y^2$ and $Y^5$ represent hydrogen atom, an alkyl group having 3 or less carbon atoms, which may be substituted (more preferably, for example, methyl group, ethyl group, propyl group, methoxymethyl group, hydroxyethyl group etc.), hydroxy group, methoxy group, ethoxy group, a monocyclic aryl group (more preferably, for example, phenyl group, tolyl group, anisyl group, 2-pyridyl group, 4-pyridyl group, 2-thienyl group, 2-furyl group etc.), acetylamino group or propionylamino group. Further, $Y^2$ and $Y^1$ or $Y^5$ and $Y^4$ may be bonded together to form methylenedioxy group, trimethylene group or tetranethylene group. $Y^3$ and $Y^6$ represent hydrogen atom, or $Y^3$ and $Y^2$ or $Y^6$ and $Y^5$ may be bonded together to form methylenedioxy group, ethylenedioxy group, trimethylene group, tetramethylene group or tetradehydrotetramethylene group. $R^1$ and $R^2$ may be the same or different from each other, and they represent an alkyl group or alkenyl group having 10 or less carbon atoms in total, which may be substituted. Examples of the substituent of the alkyl group and alkenyl group include, for example, sulfo group, carboxy group, a halogen atom, hydroxy group, an alkoxy group having 6 or less carbon atoms, an aryl group having 12 or less carbon atoms, which may be substituted (for example, phenyl group, tolyl group, sulfophenyl group, carboxyphenyl group, naphthyl group, 5-methylnaphthyl group, 4-sulfonaphthyl group etc.), a heterocyclic group (for example, furyl group, thienyl group etc.), an aryloxy group having 12 or less carbon atoms, which may be substituted (for example, chlorophenoxy group, phenoxy group, sulfophenoxy group, hydroxyphenoxy group, naphthyloxy group etc.), an acyl group having 8 or less carbon atoms (for example, benzenesulfonyl group, methanesulfonyl group, acetyl group, propionyl group etc.), an alkoxycarbonyl group having 6 or less carbon atoms (for example, ethoxycarbonyl group, butoxycarbonyl group etc.), cyano group, an alkylthio group having 6 or less carbon atoms (for example, methylthio group, ethylthio group etc.), an arylthio group having 8 or less carbon atoms, which may be substituted (for example, phenylthio group, tolylthio group etc.), a carbamoyl group having 8 or less carbon atoms, which may be substituted (for example, carbamoyl group, N-ethylcarbamoyl group etc.), an acylamino group having 8 or less carbon atoms (for example, acetylamino group, methanesulfonylamino group etc.), an acylaminocarbonyl group having 8 or less carbon atoms (for example, acetylaminocarbonyl group, methanesulfonylaminocarbonyl group etc.), a ureido group having 7 or less carbon atoms (for example, 3-ethylureido group, 3,3-dimethylureido group etc.) and so forth. The aforementioned groups may have one or more substituents. $R^3$ and $R^5$ represent hydrogen atom, or $R^3$ and $R^1$ or $R^5$ and $R^2$ may be bonded together to form a 5- or 6-membered ring. $R^4$ represents hydrogen atom or a lower alkyl group which may be substituted. $R^6$ represents hydrogen atom, methyl group, ethyl group or propyl group, and $R^7$ represents a lower alkyl group which may be substituted, or phenyl group which may be substituted. X represents a counter ion required for neutralizing the electric charge. n represents 0 or 1. When the compound forms an intramolecular salt, n is 0.

Specific examples of the aforementioned nitrogen-containing heterocyclic nucleus in which $Z^1$ or $Z^2$ one of the atoms constituting the nucleus include, for example, benzothiazole, 5-methylbenzothiazole, 5-ethylbenzothiazole, 5-propylbenzothiazole, 5,6-dimethylbenzothiazole, 5-methoxybenzothiazole, 5-ethoxybenzothiazole, 5,6-dimethoxybenzothiazole, 5-methoxy-6-methylbenzothiazole, 5-phenylbenzothiazole, 5-p-tolylbenzothiazole, 5-acetylaminobenzothiazole, 5-propionylamiaobenzothiazole, 5-hydroxybenzothiazole, 5-hydroxy-6-methylbenzothiazole, 5,6-dioxymethylenebenzothiazole, 4,5-dioxymethylenebenzothiazole, 5,6-trimethylenebenzothiazole, naphtho-[1,2-d]thiazole, 5-methylnaphtho[1,2-d]thiazole, 8-methoxy-naphtho[1,2-d]thiazole, 8,9-dihydronaphthothiazole, benzoselenazole, 5-methylbenzoselenazole, 5-ethylbenzoselenazole, 5-methoxybenzoselenazole, 5-ethoxybenzoselenazole, 5,6-di-methylbenzoselenazole, 5-hydroxybenzoselenazole, 5-hydroxy-6-methylbenzoselenazole, naphtho[1,2-d]selenazole and so forth.

Specific examples of $R^1$ and $R^2$ include, for example, methyl group, ethyl group, propyl group, allyl group, pentyl group, hexyl group, methoxyethyl group, ethoxyethyl group, phenethyl group, tolylethyl group, phenoxyethyl group, phenoxypropyl group, naphthoxyethyl group, sulfophenethyl group, 2,2, 2-trifluoroethyl group, 2,2,3,3-tetrafluoropropyl group, carbamoylethyl group, hydroxyethyl group, 2-(2-hydroxyethoxy)-ethyl group, carboxymethyl group, carboxyethyl group, ethoxycarbonylmethyl group, sulfoethyl group, 2-chloro-3-sulfopropyl group, 3-sulfopropyl group, 2-hydroxy-3-sulfopropyl group, 3-sulfobutyl group, 4-sulfobutyl group, 2-(2,3-dihydroxypropyloxy)ethyl group, 2-[2-(3-sulfopropyloxy)ethoxy]ethyl group, acetylaminoethyl group, methylsulfonylaminoethyl group, methylsulfonylamino-carbonylethyl group, acetylaminocarbonylethyl group and so forth. Preferred examples of the lower alkyl group represented by $R^4$, which may be substituted, include methyl group, ethyl group, propyl group, and benzyl group, and preferred examples of the lower alkyl group or phenyl group represented by $R^7$, both of which may be substituted, include methyl group, ethyl group, propyl group, butyl group, benzyl group, phenyl group, p-methoxyphenyl group, p-tolyl group and so forth. Specific examples of the counter ion represented by X include, when it is a cation, an alkali metal ion such as potassium ion and sodium ion, ammonium ion such as triethylammonium ion and N,N-dimethylbenzylammonium ion, immonium ion such as pyridinium ion and so forth, and when it is an anion, a halide ion such as chlorine ion, bromine ion and iodine ion, sulfonate ion such as p-toluenesulfonate ion and benzenesultonate ion, carboxylate ion such as acetate ion and so forth.

Among the sensitizing dyes represented by the aforementioned general formula (I), more preferred sensitizing dyes are those represented by the general formula (I) in which at least one of $Z^1$ and $Z^2$ represents sulfur atom, $Y^1$ and $Y^4$ represent hydrogen atom, and $Y^2$ and $Y^5$ represent hydrogen atom, methyl group, ethyl group, propyl group, methoxymethyl group, hydroxyethyl group, hydroxy group, methoxy group, ethoxy group, phenyl group or acetylamino group, or $Y^2$ and $Y^3$ or $Y^5$ and $Y^6$ together represent methylenedioxy group, tetramethylene group or tetradebydrotetramethylene group, and $R^6$ represents hydrogen atom.

Specific examples of the sensitizing dyes represented by the general formula (I) are listed below in order to explain the present invention more specifically. However, the compounds that can be used for the present invention are not limited to these.

I-1

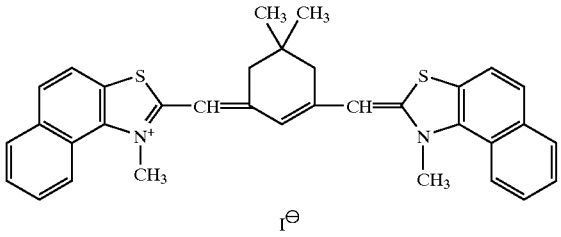

I-2

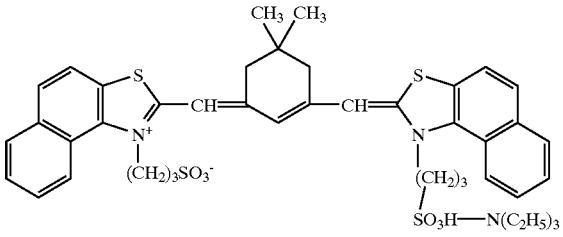

I-3

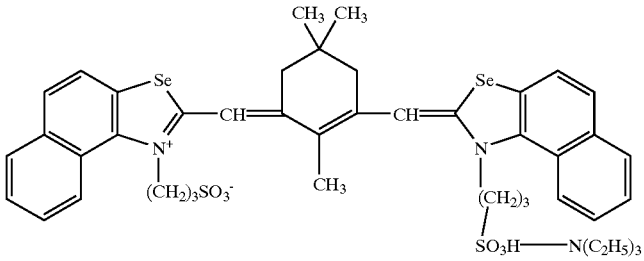

-continued
I-4
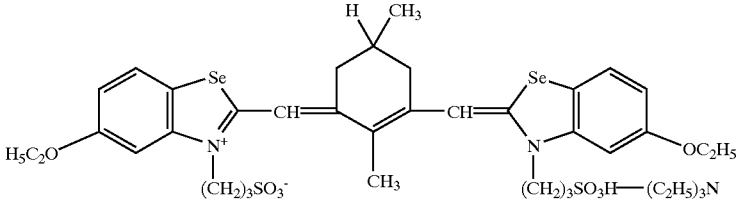
I-5
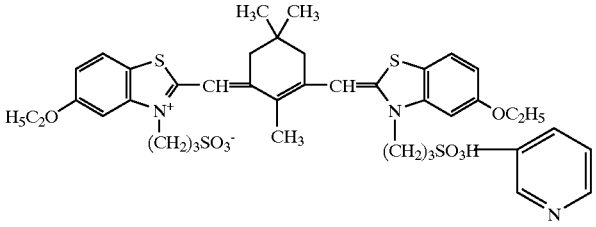
I-6
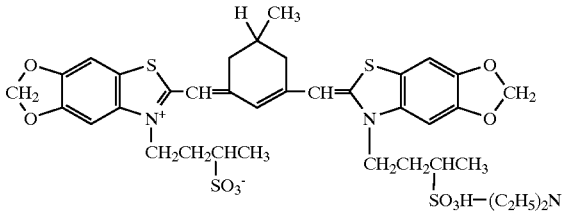
I-7
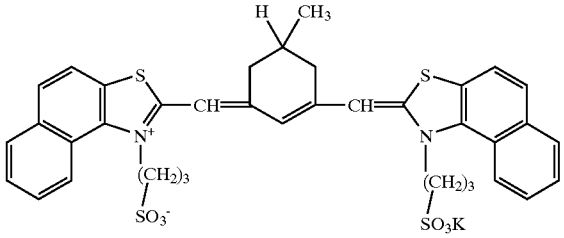
I-8
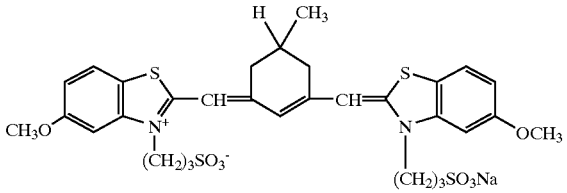
I-9
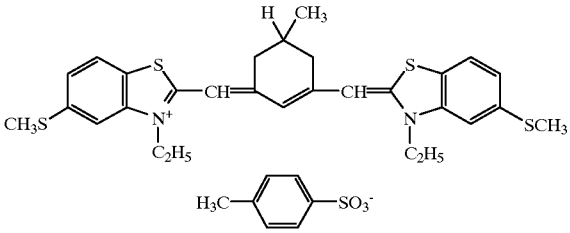
I-10
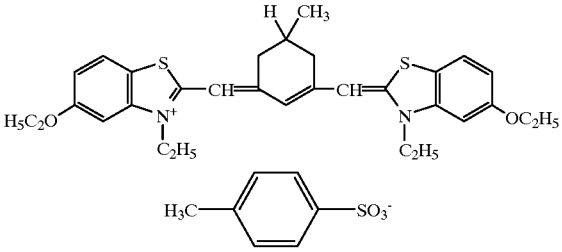
I-11
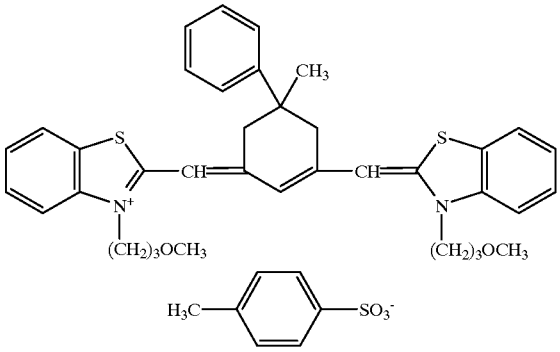
I-12
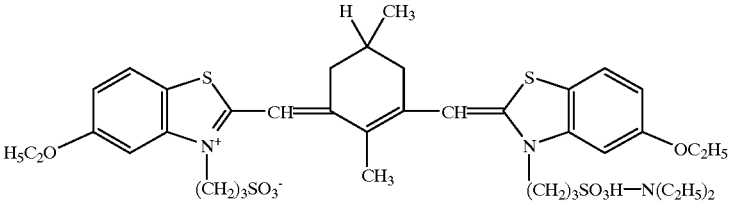

-continued
I-13
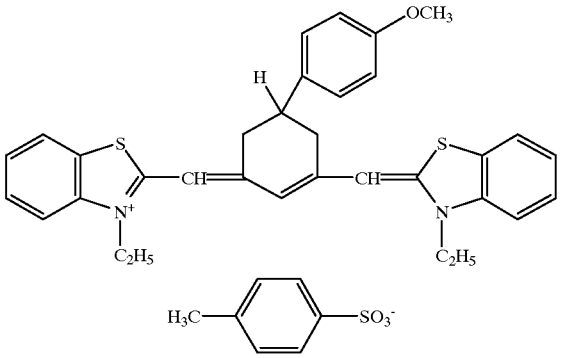
I-14
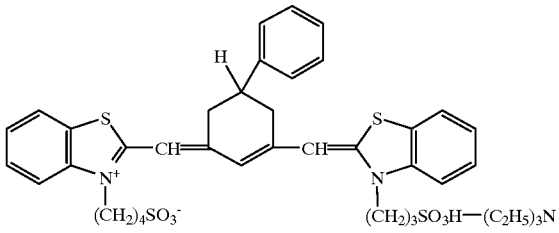
I-15
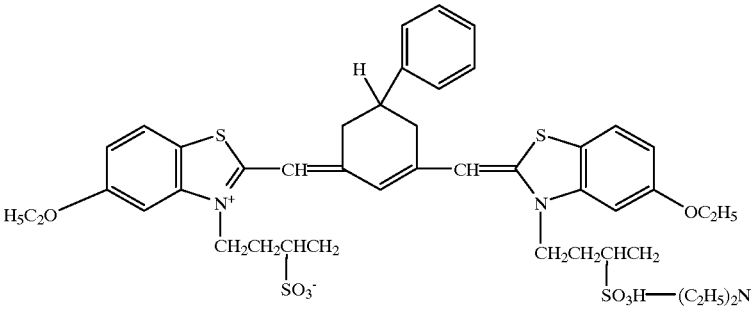
I-16
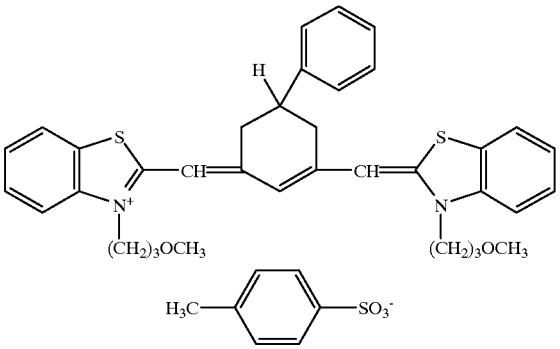
I-17
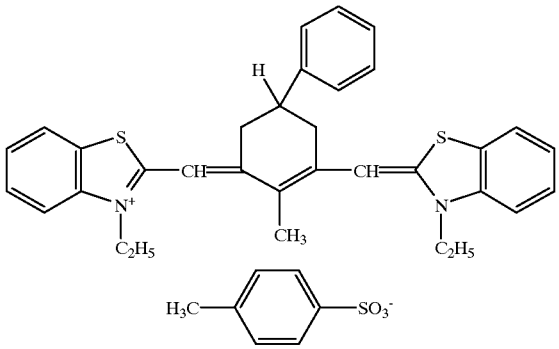
I-18
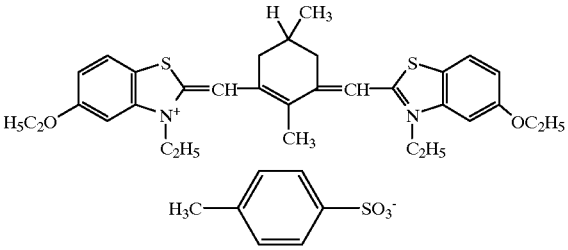
I-19
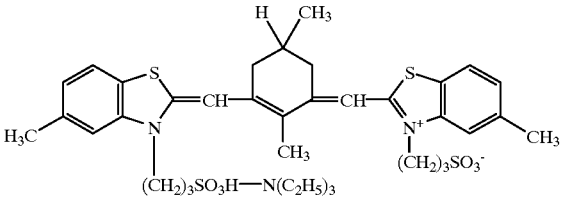

-continued

I-20

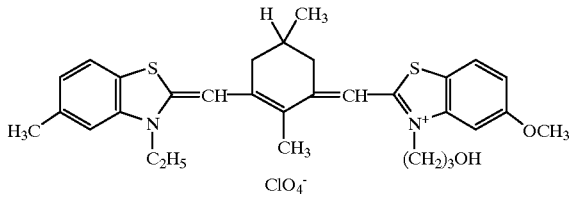

I-21

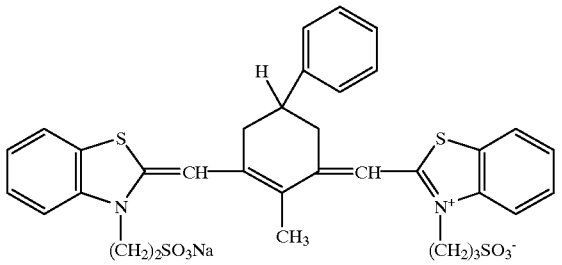

I-22

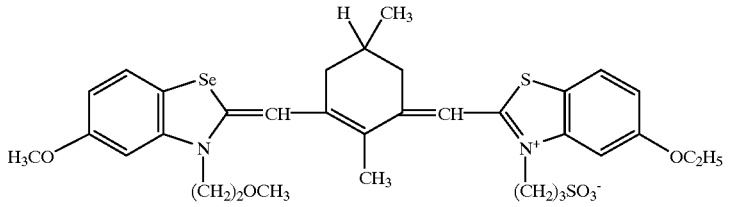

The sensitizing dyes represented by the general formula (I) used for the present invention are known compounds, and they can be synthesized by referring to, for example, JP-A-52-104917, Japanese Patent Publication (Kokoku, hereinafter referred to as JP-B) 48-25652, JP-B-57-22268, F. M. Hamer, The Chemistry of Heterocyclic Compounds, vol. 18, "The Cyanine Dyes and Related Compounds", A. Weissbergered., Interscience, New York, 1964., D. M. Sturmer, "The Chemistry of Heterocyclic Compounds", vol. 30, A. Weissberger and E. C. Taylored., John Willy, New York, p.441., JP-A-4-146966 and so forth.

For inclusion of the cyanine dyes represented by the general formula (I) for use in the present invention in a silver halide emulsion, they may be directly dispersed in the emulsion, or they may be dissolved in a single or mixed solvent of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and so forth, and then added to the emulsion. Further, there can also be used for the inclusion of the sensitizing dyes in the emulsion, for example, a method in which a dye is dissolved in a volatile organic solvent, this solution is dispersed in water or hydrophilic colloid and this dispersion is added to an emulsion as disclosed in U.S. Pat. No. 3,469,987, a method in which a water-insoluble dye is dispersed in a water-soluble solvent not being dissolved and this dispersion is added to an emulsion as disclosed in JP-B-46-24185, a method in which adye is dissolved in an acid and this solution is added to an emulsion, or a dye is added to an emulsion as an aqueous solution containing an acid or base as disclosed in JP-B-44-23389, JP-B-44-27555 and JP-B-57-22091, a method in which a dye is added to an emulsion as an aqueous solution or colloidal dispersion containing a surfactant as disclosed in U.S. Pat. Nos. 3,822,135 and 4,006,025, a method in which a dye is directly dispersed in a hydrophilic colloid and this dispersion is added to an emulsion as disclosed in JP-A-53-102733 and JF-A-58-105141, or a method in which a dye is dissolved by using a compound that can cause red shift of the dye and this solution is added to an emulsion as disclosed in JP-A-51-74624. Furthermore, ultrasonic waves can be used for dissolution.

The sensitizing dye used in the present invention may be added to a silver halide emulsion during any step known to be useful in the preparation of photographic emulsion. For example, the dye may be added during a step of formation of silver halide grains and/or a period before desalting, or a step of desalting and/or a period after desalting and before initiation of chemical ripening, as disclosed in, for example, U.S. Pat. Nos. 2,735,766, 3,628,960, 4,183,756, 4,225,666, JP-A-58-184142 and JP-A-60-196749, or the dye may be added during any period or any step before coating of the emulsion, such as immediately before or during chemical ripening or a period after chemical ripening but before coating, as disclosed in JP-A-58-113920 and so forth. Further, a sole kind of compound alone or compounds different in structure in combination may be added as divided portions in different process steps. For example, a part and the remaining part may be added during the same step; a part may be added during the grain formation, and the remaining part during chemical ripening or after completion of the chemical ripening; or a part may be added before or during chemical ripening, and the remaining part after completion of the chemical ripening, as disclosed in, for example, U.S. Pat. No, 4,225,666 and JP-A-58-7629. The kind of compounds added as the divided portions or the kind of combination of compounds maybe changed, Furthermore, a given amount of dye may be added within a short period of time, or a long period of time. For example, the dye may be continuously added during the period after the nucleus formation in the grain formation process and before completion of the grain formation or almost all over the process of chemical ripening. More preferred addition time is at an arbitrary time after nucleus formation in the silver halide grain formation process and before completion of the first half of the chemical ripening.

In the present invention, in order to make the advantage of the present invention more marked, the sensitizing dye is more preferably added to the silver halide emulsion of the present invention in combination with a tetrazaindene compound represented by the following general formula (II) or (III).

Formula (II)

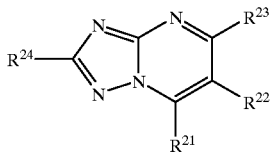

Formula (III)

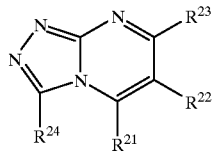

In the formulas, $R^{21}$, $R^{22}$, $R^{23}$ and $R^{24}$ may be the same or different from One another, and each represent hydrogen atom, a substituted or unsubstituted alkyl group having 1–20 carbon atoms in total, which may be a cyclic- or branched alkyl group, a substituted or unsubstituted monocyclic or bicyclic aryl group, a substituted or unsubstituted amino group, hydroxy group, an alkoxy group having 1–20 carbon atoms in total, an alkylthio group having 1–6 carbon atoms in total, a carbamoyl group which may be substituted with an aliphatic group or an aromatic group, a halogen atom, cyano group, carboxy group, an alkoxycarbonyl group having 2–20 carbon atoms in total, or a heterocyclic residue containing a 5- or 6-membered ring having one or more hetero atoms such as nitrogen atom, oxygen atom and sulfur atom. $R^{21}$ and $R^{22}$ or $R^{22}$ and $R^{23}$ may be bonded together to form a 5- or 6-membered ring. However, at least one of $R^{21}$ and $R^{23}$ represents hydroxy group.

Examples of the aforementioned unsubstituted alkyl group include, for example, methyl group, ethyl group, n-propyl group, i-propyl group, tert-propyl group, n-butyl group, tert-butyl group, hexyl group, cyclohexyl group, cyclopentylmethyl group, octyl group, dodecyl group, tridecyl group, heptadecyl group and so forth, Examples of the substituent of the aforementioned substituted alkyl group include, for example, a monocyclic or bicyclic aryl group, a heterocyclic residue, a halogen atom, carboxy group, an alkoxycarbonyl group having 2–6 carbon atoms, an alkoxy group having 19 or less carbon atoms, hydroxy group, and so forth. Examples of the substituted alkyl group include, for example, benzyl group, phenethyl group, chloromethyl group, 2-chloroethyl group, trifluoromethyl group, carboxymethyl group, 2-carboxyethyl group, 2-(methoxycarbonyl)ethyl group, ethoxycarbonylmethyl group, 2-methoxyethyl group, hydroxymethyl group, 2-hydroxyethyl group and so forth. Examples of the aforementioned unsubstituted aryl group include, for example, phenyl group, naphthyl group and so forth. Examples of the substituent of the substituted aryl group include, for example, an alkyl group having 4 or less carbon atoms, a halogen atom, carboxy group, cyano group, an alkoxycarbonyl group having 6 or less carbon atoms, hydroxy group, an alkoxy group having 6 or less carbon atoms and so forth. Examples of the substituted aryl group include, for example, p-tolyl group, m-tolyl group, p-chlorophenyl group, p-bromophenyl group, o-chlorophenyl group, m-cyanophenyl group, p-carboxyphenyl group, o-carboxyphenyl group, o-(methoxycarbonyl) phenyl group, p-hydroxyphenyl group, p-methoxyphenyl group, m-ethoxyphenyl group and so forth. Examples of the substituent of the aforementioned substituted amino group include, for example, an alkyl group (for example, methyl group, ethyl group, butyl group etc.), an acyl group (for example, acetyl group, propionyl group, benzoyl group, methylsulfonyl group etc.), and specific examples of the substituted amino group include, for example, dimethylamino group, diethylamino group, butylamino group, acetylamino group and so forth. Specific examples of the aforementioned alkoxy group include, for example, methoxy group, ethoxy group, butoxy group, heptadecyloxy group and so forth, Specific examples of the aforementioned alkylthio group include, for example, methylthio group, ethylthio group, hexylthio group and so forth. The aforementioned carbamoyl group may have one or two of alkyl groups having 20 or less carbon atoms or mono- or bicyclic aryl groups as substituents. Specific examples of the substituted carbamoyl group include methylcarbamoyl group, dimethylcarbamoyl group, ethylcarbamoyl group, phenylcarbamoyl group and so forth. Specific examples of the aforementioned alkoxycarbonyl group include, for example, methoxycarbonyl group, ethoxycarbonyl group, butoxycarbonyl group and so forth. Specific examples of the aforementioned halogen atom include fluorine atom, chlorine atom and bromine atom. The aforementioned heterocyclic residue may be monocyclic or may have bi- or tricyclic condensed ring, and specific examples thereof include, for example, furyl group, pyridyl group, 2-(3-methyl) benzothiazolyl group, 1-benzotriazolyl group and so forth. In the aforementioned substituted alkyl group, when the substituent of the substituted alkyl group represented by $R^{24}$ is a heterocyclic residue, a substituent represented by the following general formula (IV) is preferred as the heterocyclic residue.

Formula (IV)

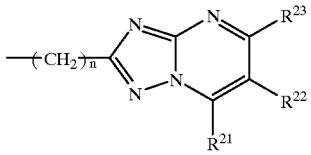

In the above formula, $R^{21}$, $R^{22}$ and $R^{23}$ have the same meanings as defined above, and n represents 2, 3 or 4. In the present invention, the compound represented by the general formula (II) or (III) may be contained in an amount of $1\times10^{-5}$ to 0.2 mole, particularly $3\times10^{-4}$ to 0.02 mole, per mole of silver halide. However, the amount of the compound is desirably selected as an optimum amount depending on grain size and halogen composition of silver halide emulsion, method and degree of chemical sensitization, relationship between image-forming layer (emulsion layer, photosensitive layer) and other layers, kind of antifoggant compound and so forth. Test methods for such selection are well known to those skilled in the art and readily performed. In the present invention, in order to attain inclusion of the compound represented by the general formula (II) or (III) in the silver halide emulsion of the present invention, the compound may be directly dispersed in the emulsion, or it may be added as a solution in a water-miscible solvent or aqueous solution when it is water-soluble or as a dispersion in a hydrophilic colloid solution in the exactly same manner as the addition of the aforementioned cyanine dyes represented by the general formula (I) It may be preferable for dissolution to prepare an alkaline solution. In the present invention, the compounds represented by the general formula (II) or (III) may be added to a silver halide emulsion at an arbitrary time during a period of from the grain formation of silver halide to coating of the silver halide emulsion. However, it is more preferred that a suitable fraction of the addition amount of $3\times10^{-3}$ mole or less per mole of silver should be selected depending on the kind of silver halide and grain size (such an amount that the absorption strength obtained by the sensitizing dye should not be decreased or the absorption strength should otherwise become sharp and increase) and added before the addition of the cyanine dyes represented by the aforementioned general formula (I). As for high silver chloride content emulsion, it is more preferred that the compound in such an amount should be added at a time before starting the chemical ripening. By using such an addition method, fog will be more effectively suppressed, and sensitivity will also be enhanced, Specific examples of the compounds represented by the general formula (II) or (III) will be mentioned below. However, the present invention is not limited to these specific compounds.

II-1

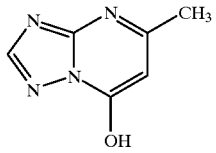

II-2

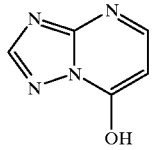

II-3

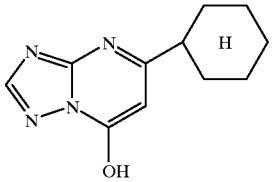

II-4

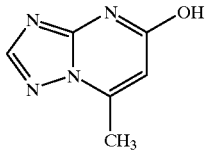

II-5

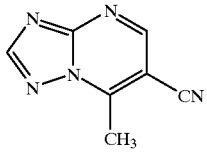

II-6

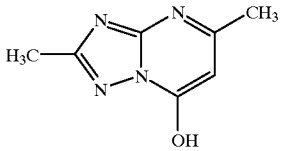

-continued

II-7

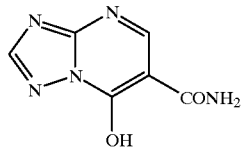

II-8

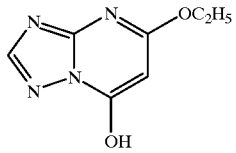

II-9

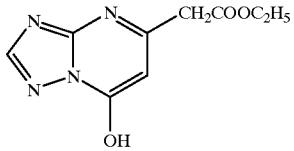

II-10

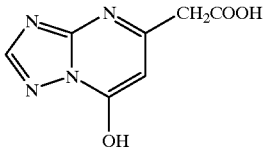

II-11

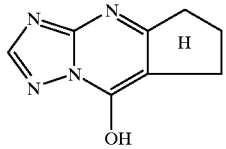

II-12

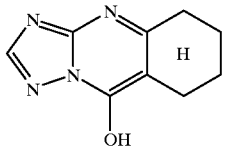

II-13

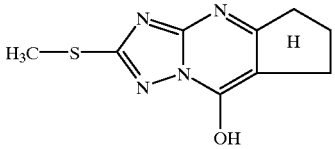

II-14

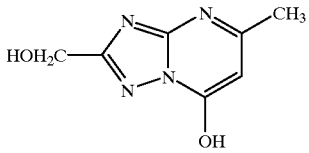

II-15

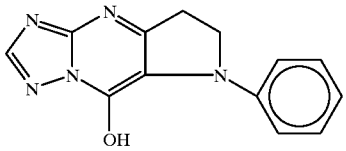

-continued

III-1

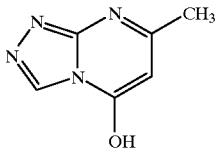

III-2

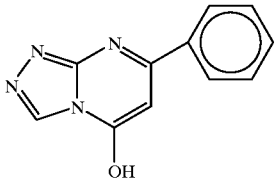

III-3

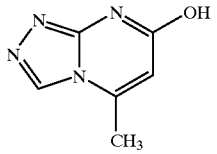

The silver halide emulsion used in the present invention may contain a methine dye and/or a supersensitizer other than the cyanine dye of the present invention for the purposes of enlargement of the sensitive wavelength region, supersensitization and so forth. When silver halide grains other than the silver halide grains of the present invention are contained in the same layer or a separate layer, those silver halide grains may be spectrally sensitized of course with the cyanine dye of the present invention, or with other methine dyes or supersensitizers.

Examples of the dye used for the present invention include, for example, cyanine dyes, merocyanine dyes, complex cyanine dyes, complex merocyanine dyes, holopolar cyanine dyes, hemicyanine dyes, styryl dyes, hemioxonol dyes and so forth. Particularly useful dyes are those belonging to cyanine dyes, merocyanine dyes, complex cyanine dyes. These dyes may have any of nuclei usually contained in cyanine dyes as a basic heterocyclic nucleus. That is, they may have pyrroline nucleus, oxazoline nucleus, thiazoline nucleus, selenazoline nucleus, pyrrole nucleus, oxazole nucleus, thiazole nucleus, selenazole nucleus, imidazole nucleus, tellurazole nucleus, pyridine nucleus, tetrazole nucleus and so forth; nuclei consisting those nuclei condensed with an alicyclic hydrocarbon ring; nuclei consisting those nuclei condensed with an aromatic hydrocarbon ring such as indolenine nucleus, benzindolenine nucleus, indole nucleus, benzoxazole nucleus, naphthoxazole nucleus, benzimidazole nucleus, naphthimidazole nucleus, benzothiazole nucleus, naphthothiazole nucleus, benzoselenazole nucleus, naphthoselenazole nucleus, quinoline nucleus, benzotellurazole nucleus and so forth. These heterocyclic nuclei may have one or more substituents on carbon atoms.

The melocyanine dyes and complex melocyanine dyes may contain any of nuclei usually used for melocyanine dyes as a nucleus having a ketomethylene structure. Particularly useful nuclei are 5- or 6-membered heterocyclic nuclei such as pyrazolin-5-one nucleus, thiohydantoin nucleus, 2-thioxazolidine-2,4-dione nucleus, thiazolidine-2,4-dione nucleus, rhodanine nucleus, thiobarbituric acid nucleus and 2-thioselenazolizine-2,4-dione nucleus.

These sensitizing dyes may be used each alone or as a combination of two or more of them. Combinations of sensitizing dyes are frequently used, in particular, for supersensitization. Representative examples thereof are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,614,609, 3,837,862, 4,026,707, British Patents 1,344,281, 1,507,803, JP-B-43-4936, JP-B-53-12375, JP-A-52-110618, JP-A-52-109925 and so forth.

Representative examples of the supersensitizer include bispyridinium salt compounds described in JP-A-59-142541 and so forth, stilbene derivatives described in JP-B-59-18691 and so forth, water-soluble bromides described in JP-B-49-46932 and so forth, condensates of aromatic compound with formaldehyde described in U.S. Pat. No. 3,743,510, cadmium salts and azaindene comapounds, the compounds disclosed in EP-A-587338, U.S. Pat. Nos. 3,877,943 and 4,873,184, compounds selected from heteroaromatic or aliphatic mercapto compounds, heteroaromatic disulfide compounds, stilbenes, hydrazines and triazines, and so forth.

Particularly preferred supersensitizers are the heteroaromatic mercapto compounds and heteroaromatic disulfide compounds disclosed in JP-A-5-341432, compounds represented by the formulas (I) and (II) mentioned in JP-A-4-182639, stilbene compounds represented by the formula (I) mentioned in JP-A-10-111543 and compounds represented by the formula (I) mentioned in JP-A-11-109547. Specifically, there can be mentioned the compounds of M-1 to M-24 mentioned in JP-A-5-341432, the compounds of d-1) to d-14) mentioned in JP-A-4-182639, the compounds of SS-01 to SS-07 mentioned in JP-A-10-111543 and the compounds of 31, 32, 37, 38, 41-45 and 51–53 mentioned in JP-A-11-109547.

These supersensitizers can be added to the image-forming layer preferably in an amount of $10^{-4}$ mole, more preferably in an amount of 0.001–0.3 mole, per mole of silver halide.

These methine dyes may be added to a silver halide emulsion during any step conventionally known to be useful in the preparation of emulsion, and added by any method and in any amount conventionally known to be useful. Specifically, they may be added, for example, according to the addition time, addition method and addition amount mentioned above for the cyanine dyes represented by the general formula (I).

The sensitizing dyes for infrared region frequently cause fog depending on the addition condition therefor. The compounds represented by the general formula (II) or (III) prevent the fog as mentioned above, and therefore they are preferred also in this respect. Further, many of benzothiazole quaternary salt compounds and the compounds represented by the following general formula (V) also favorably suppress fog and provide supersensitization. They are preferably added at any time after addition of the sensitizing dye of the present invention, and during the period after the beginning of the second half of the chemical sensitization and before coating when chemical sensitization is performed. The addition amount thereof is preferably 0.3–10 equivalents with respect to the sensitizing dye used for the present invention.

Formula (V)

$$Z^{61}—(V^{61})_{m^{61}}$$

In the formula, $Z^{61}$ is specifically an azole ring (e.g., imidazole, triazole, tetrazole, thiazole, oxazole, selenazole, benzimidazole, benzindazole, benzotriazole, benzoxazole, benzothiazole, thiadiazoleoxadiazole, benzoselenazole, pyrazole, naphthothiazole, naphthimidazole, naphthoxazole, azabenzimidazole, purine etc.), pyrimidine ring, triazine ring, pyridine ring, azaindene ring (e.g., triazaindene, pentaindene etc.).

$V^{61}$ represents hydrogen atom or a substituent. Specific examples of the substituent include a substituted or unsubstituted alkyl group (e.g., methyl, ethyl, hydroxyethyl, trifluoromethyl, sulfopropyl, dipropylaminoethyl, adamantyl, benzyl, p-chlorophenethyl, ethoxyethyl, ethylmercaptoethyl, cyanopropyl, phenoxyethyl, carbamoylethyl, carboxyethyl, ethoxycarbonylpropyl, acetylarninoethyl etc.), a substituted or unsubstituted alkenyl group (e.g., allyl etc.), a substituted or unsubstituted aryl group (e.g., phenyl, naphthyl, p-carboxyphenyl, 3,5-dicarboxyphenyl, m-sulfophenyl, p-acetamidophenyl, 3-caprylamidophenyl, p-sulfamoylphenyl, m-hydroxyphenyl, p-nitrophenyl, 3,5-dichlorophenyl, p-anisyl, o-anisyl, p-cyanophenyl, p-N'-methylureidophenyl, m-fluorophenyl, p-tolyl, m-tolyl etc.), a heterocyclic residue which may be substituted (e.g., pyridyl, 5-methyl-2-pyridyl, thienyl etc., a halogen atom (e.g., chlorine, bromine etc.), nercapto group, cyano group, carboxy group, sulfo group, hydroxy group, carbamnoyl group, sulfainoyl group, amido group, nitro group, an alkoxy group which may be substituted (e.g., methoxy, ethoxy, 2-methoxyethoxy, 2-phenylethoxyetc.), an aryloxy group which may be substituted (e.g., phenoxy, p-methylphenoxy etc.), an acyl group (e.g., acetyl, benzoyl, methanesulfonyl etc.), an acylamino group (e.g., acetylamino, caproylamino, methylsulfonylamino etc.), a substituted amino group (e.g., diethylamino, hydroxyamino etc.), an alkyl- or arylthio group (e.g., methylthio, carboxyethyl, sulfobutylthio etc.), an alkoxycarbonyl group (e.g., methoxycarbonyl etc.), an aryloxycarbonyl group (e.g., phenoxycarbonyl etc.) and so forth.

$m^{61}$ represents a positive integer of 5 or less, and it means that a plurality of the same and/or different substituents represented by the above $V^{61}$ may be present. Among the compounds represented by the general formula (V), more preferred are mercapto-substituted azole ring compounds.

The photothermographic material of the present invention utilizes a non-photosensitive silver salt. As the non-photosensitive silver salt used for the present invention, a silver salt of an organic is preferred.

The silver salt of an organic acid that can be used in the present invention is a silver salt relatively stable against light, but forms a silverimage when it is heated at 80° C. or higher in the presence of an exposed photocatalyst (e.g., a latent image of photosensitive silver halide) and a reducing agent. The silver salt of an organic acid may be any organic substance containing a source of reducible silver ion. Silver salts of an organic acid, in particular, silver salts of a long chain aliphatic carboxylic acid having from 10 to 30, preferably from 15 to 28 carbon atoms, are preferred. Complexes of organic or inorganic acid silver salts of which ligands have a complex stability constant in the range of 4.0–10.0 are also preferred. The silver supplying substance, can preferably constitute about 5–70 weight % of the image-forming layer. Preferred examples of the silver salts of an organic acid include silver salts of organic compounds having carboxyl group. Specifically, the silver salts of an organic acid may be silver salts of an aliphatic carboxylic acid and silver salts of an aromatic carboxylic acid, but not limited to these. Preferred examples of the silver salts of an aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate, mixtures thereof and so forth.

In the present invention, there is preferably used silver salt of an organic acid having a silver behenate content of 75 mole % or more, more preferably silver salt of an organic acid having a silver behenate content of 85 mole % or more, among the aforementioned silver salts of an organic acid and mixtures of silver salts of an organic acid. The silver behenate content used herein means a molar percentage of silver behenate with respect to silver salt of an organic acid to be used, As silver salts of an organic acid other than silver behenate contained in the silver salts of organic acid used for the present invention, the silver salts of an organic acid exemplified above can preferably be used.

Silver salts of an organic acid that can be preferably used in the present invention can be prepared by allowing a solution or suspension of an alkali metal salt (e.g., Na salts, K salts, Li salts) of the aforementioned organic acids to react with silver nitrate. As the preparation method, the method described in Japanese Patent Application No. 11-104187, paragraphs 0019–0021 can be used.

In the present invention, a method of preparing a silver salt of an organic acid by adding an aqueous solution of silver nitrate and a solution of alkali metal salt of an organic acid to a sealable means for mixing liquids can preferably be used. Specifically, the method described in Japanese Patent Application No. 11-203413 can be used.

In the present invention, a dispersing agent soluble in water can be added to the aqueous solution of silver nitrate and the solution of alkali metal salt of an organic acid or reaction mixture, when the silver salt of an organic acid is prepared. Type and amount of the dispersing agent used in this case are specifically mentioned in Japanese Patent Application No. 11-115457, paragraph 0052.

The silver salt of an organic acid for use in the present invention is preferably prepared in the presence of a tertiary alcohol. The tertiary alcohol preferably has a total carbon number of 15 or less, more preferably 10 or less. Examples of preferred tertiary alcohols include tert-butanol. However, tertiary alcohol that can be used for the present invention is not limited to it.

The tertiary alcohol for use in the present invention may be added at any time during the preparation of the organic acid silver salt, but the tertiary alcohol is preferably used by adding at the time of preparation of the organic acid alkali metal salt to dissolve the organic acid alkali metal salt. The tertiary alcohol for use in the present invention may be added in any amount of from 0.01–10 in terms of the weight ratio to water used as a solvent for the preparation of the silver salt of an organic acid, but preferably added in an amount of from 0.03–1 in terms of weight ratio to water.

Although shape and size of the organic acid silver salt are not particularly limited, those mentioned in Japanese Patent Application No. 11-104187, paragraph 0024 can be preferably used, The shape of the organic acid silver salt can be determined from a transmission electron microscope image of organic silver salt dispersion. An example of the method for determining monodispesibility is a method comprising obtaining standard deviation of volume weight average diameter of the organic acid silver salt. The percentage of a value obtained by dividing standard deviation by volume weight average diameter (variation coefficient) is preferably 80% or less, more preferably 50% or less, particularly preferably 30% or less. As for the measurement method, for example, the grain size can be determined by irradiating organic acid silver salt dispersed in a solution with a laser ray and determining an autocorrelation function for change of the fluctuation of the scattered light with time (volume weight average diameter). The average grain size determined by this method is preferably from 0.05–10.0 μm, more preferably from 0.1–5.0 μm, further preferably from 0.1–2.0 μm, as grains in solid microparticle dispersion.

The silver salt of an organic acid that can be used in the present invention is preferably desalted. The desalting method is not particularly limited and any known methods may be used. Known filtration methods such as centrifugal filtration, suction filtration, ultrafiltration and flocculation washing by coagulation may be preferably used. As the method of ultrafiltration, the method described in Japanese Patent Application No. 11-115457 can be used.

For obtaining an organic acid silver salt solid dispersion having a high S/N ratio and a small grain size and being free from coagulation, there is preferably used a dispersion method comprising steps of converting an aqueous dispersion that contains a silver salt of an organic acid as an image-forming medium and contains substantially no photosensitive silver salt into a high-speed flow, and then releasing the pressure. As such a dispersion method, the method mentioned in Japanese Patent Application No. 11-104187, paragraphs 0027–0038 can be used, The grain size distribution of the silver salt of an organic acid preferably corresponds to monodispersion. Specifically, the percentage (variation coefficient) of the value obtained by dividing standard deviation of volume weight average diameter by volume weight average diameter is preferably 80% or less, more preferably 50% or less, particularly preferably 30% or less.

The organic acid silver salt solid grain dispersion used for the present invention consists at least of a silver salt of an organic acid and water, While the ratio of the silver salt of an organic acid and water is not particularly limited, the ratio of the silver salt of an organic acid is preferably in the range of 5–50 weight %, particularly preferably 10–30 weight %, with respect to the total weight. While it is preferred that the aforementioned dispersing agent should be used, it is preferably used in a minimum amount within a range suitable for minimizing the grain size, and it is preferably used in an amount of 0.5–30 weight %, particularly preferably 1–15 weight %, with respect to the silver salt of an organic acid.

The silver salt of an organic acid for use in the present invention may be used in any desired amount. However, it is preferably used in an amount of from 0.1–5 g/m$^2$, more preferably from 1–3 g/m$^2$, in terms of silver amount.

In the present invention, metal ions selected from Ca, Mg, Zn and Ag are preferably added to the non-photosensitive silver salt of an organic acid. The metal ions selected from Ca, Mg, Zn and Ag are preferably added to the non-photosensitive silver salt of an organic acid in the form of a water-soluble metal salt, not a halide compound. Specifically, they are preferably added in the form of nitrate or sulfate. Addition of halide is not preferred, since it degrades image storability, i.e., so-called printing-out property, of the photosensitive material against light (indoor light, sun light etc.) after the development. Therefore, in the present invention, it is preferable to add the ions in the form of water-soluble metal salts, which are not the aforementioned halide compound.

The metal ions selected from Ca, Mg, Zn and Ag, which are preferably used in the present invention, may be added any time after the formation of non-photosensitive organic acid silver salt grains and immediately before the coating operation, for example, immediately after the formation of grains, before dispersion, after dispersion, before and after the formation of coating solution and so forth. They are preferably added after dispersion, or before or after the formation of coating solution.

In the present invention, the metal ions selected from Ca, Mg, Zn and Ag are preferably added in an amount of $10^{-3}$ to $10^{-1}$ mole, particularly $5\times10^{-3}$ to $5\times10^{-2}$ mole, per one mole of non-photosensitive silver salt of an organic acid.

The photothermographic material of the present invention contains a silver halide.

The photosensitive silver halide used for the present invention is not particularly limited as for the halogen composition, and silver chloride, silver chlorobromide, silver bromide, silver iodobromide, silver chloroiodobromide and so forth may be used. As for the preparation of grains of the photosensitive silver halide emulsion, the grains can be prepared by the method described in JP-A-11-119374, paragraphs 0217–0224. However, the method is not particularly limited to this method.

Examples of the form of silver halide grains include a cubic form, octahedral form, tetradecahedral form, tabular form, spherical form, rod-like form, potato-like form and so forth. In particular, cubic grains and tabular grains are preferred for the present invention. As for the characteristics of the grain form such as aspect ratio and surface index of the grains, they may be similar to those described in JP-A-11-119374, paragraph 0225. Further, the halogen composition may have a uniform distribution in the grains, or the composition may change stepwise or continuously in the grains. Silver halide grains having a core/shell structure may also be preferably used, Core/shell grains having preferably a double to quintuple structure, more preferably a double to quadruple structure may be used. A technique for localizing silver bromide on the surfaces of silver chloride or silver chlorobromide grains may also be preferably used.

As for the grain size distribution of the silver halide grains used in the present invention, the grains show monodispersion degree of 30% or less, preferably 1–20%, more preferably 5–15%. The monodispersion degree used herein is defined as a percentage (%) of a value obtained by dividing standard deviation of grain size by average grain size (variation coefficient). The grain size of the silver halide grains is represented as a ridge length for cubic grains, or a diameter as circle of projected area for the other grains (octahedral grains, tetradecahedral grains, tabular grains and so forth) for convenience.

The photosensitive silver halide grains preferably contain a metal of Group VII or Group VIII in the periodic table of elements or a complex of such a metal. The metal or the center metal of the complex of a metal of Group VII or Group VIII of the periodic table is preferably rhodium, rhenium, ruthenium, osmium or iridium, Particularly preferred metal complexes are $(NH_4)_3Rh(H_2O)Cl_3$, $K_2Ru(NO)Cl_5$, $K_3IrCl_6$ and $K_4Fe(CN)_6$. The metal complexes maybe used each alone, or two or more kinds of complexes of the same or different metals may also be used in combination. The metal complex content is preferably from $1\times10^{-9}$ to $1\times10^{-3}$ mole, more preferably $1\times10^{-8}$ to $1\times10^{-4}$ mole, per mole of silver. As for specific structures of metal complexes, metal complexes of the structures described in JP-A-7-225449 and so forth can be used, Types and addition methods of these heavy metals and complexes thereof are described in JP-A-11-119374, paragraphs 0227–0240.

The photosensitive silver halide grains may be desalted by washing methods with water known in the art, such as the noodle washing and flocculation. However, the grain may not be desalted in the present invention.

The photosensitive silver halide grains are preferably subjected to chemical sensitization. For the chemical sensitization, the method described in JP-A-11-119374, paragraphs 0242–0250 can preferably be used.

Silver halide emulsions used in the present invention may be added with thiosulfonic acid compounds by the method described in EP-A-293917.

As gelatin used with the photosensitive silver halide used in the present invention, low molecular weight gelatin is preferably used in order to maintain good dispersion state of the silver halide emulsion in a coating solution containing a silver salt of an organic acid. The low molecular weight gelatin has a molecular weight of 500–60,000, preferably 1,000–40,000. While such low molecular weight gelatin may be added during the formation of grains or dispersion operation after the desalting treatment, it is preferably added during dispersion operation after the desalting treatment. It is also possible to use ordinary gelatin (molecular weight of about 100,000) during the grain formation and use low molecular gelatin during dispersion operation after the desalting treatment.

While the concentration of dispersion medium may be 0.05–20 weight %, it is preferably in the range of 5–15 weight % in view of handling. As for type of gelatin, alkali-treated gelatin is usually used. Besides that, however, acid-treated gelatin, modified gelatin such as phthalated gelatin and so forth can also be used.

In the photothermographic material of the present invention, one kind of photosensitive silver halide emulsion may be used or two or more different emulsions (for example, those having different average grain sizes, different halogen compositions, different crystal habits or those subjected to chemical sensitization under different conditions) may be used in combination.

The amount of the photosensitive silver halide per mole of the silver salt of an organic acid is preferably from 0.01–0.5 mole, more preferably from 0.02–0.3 mole, still more preferably from 0.03–0.25 mole. Methods and conditions for mixing photosensitive silver halide and silver salt of an organic acid, which are prepared separately, are not particularly limited so long as the effect of the present invention can be attained satisfactorily. Examples thereof include, for example, a method of mixing silver halide grains and silver salt of an organic acid after completion of respective preparations by using a high-speed stirring machine, ball mill, sand mill, colloid mill, vibrating mill, homogenizer or the like, or a method of preparing a silver salt of an organic acid with mixing a photosensitive silver halide obtained separately at any time during the preparation of the silver salt of an organic acid. For the mixing of them, mixing two or more kinds of aqueous dispersions of the silver salt of an organic acid and two or more kinds of aqueous dispersions of the photosensitive silver salt is preferably used for controlling photographic properties.

The photothermographic material of the present invention preferably contains a nucleating agent.

While type of the nucleating agent that can be used in the present invention is not particularly limited, examples of well known nucleating agents include all of the hydrazine derivatives represented by the formula (H) mentioned in Japanese Patent Application No. 11-87297 (specifically, the hydrazine derivatives mentioned in Tables 1–4 of the same), hydrazine derivatives described in JP-A-10-10672, JP-A-10-161270, JP-A-10-62898, JP-A-9-304870, JP-A-9-304872, JP-A-9-304871, JP-A-10-31282, U.S. Pat. No. 5,496,695 and EP-A-741320.

Particularly preferably used nucleating agents are the substituted alkene derivatives, substituted isoxazole derivatives and particular acetal compounds represented by the formulas (1) to (3) mentioned in Japanese Patent Application No. 11-87297, and more preferably, the cyclic compounds represented by the formula (A) or (B) mentioned in the same, specifically Compounds 1–72 mentioned in Chem. 8 to Chem. 12 of the same may be used. Two or more of these nucleating agents may be used in combination.

The nucleating agent may be used after being dissolved in an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Further, it may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, the nucleating agent may be used by dispersing powder of the nucleating agent in a suitable solvent such as water using a ball mill, colloid mill, or by means of ultrasonic wave according to a known method for solid dispersion.

While the nucleating agent may be added to any layer on the image-forming layer side, it is preferably added to the image-forming layer or a layer adjacent thereto.

The amount of the nucleating agent is $1\times10^{-6}$ mole to 1 mole, more preferably from $1\times10^{-5}$ mole to $5\times10^{-1}$ mole, further preferably from $2\times10^{-5}$ mole to $2\times10^{-1}$ mole, per mole of silver.

In addition to the aforementioned compounds, the compounds disclosed in U.S. Pat. Nos. 5,545,515, 5,635,339, 5,654,130, International Patent Publication WO97/34196 and U.S. Pat. No. 5,686,228, and the compounds disclosed in JP-A-11-119372, Japanese Patent Application No. 9-309813, JP-A-11-119373, JP-A-11-109546, JP-A-11-95365, JP-A-11-95366 and JP-A-11-149136 may also be used.

In the present invention, a contrast accelerator may be used in combination with the above-described nucleating agent for the formation of an ultrahigh contrast image. For example, amine compounds described in U.S. Pat. No. 5,545,505, specifically, AM-1 to AM-5; hydroxamic acids described in U.S. Pat. No, 5,545,507, specifically, HA-1 to HA-11; acrylonitriles described in U.S. Pat. No. 5,545,507, specifically, CN-1 to CN-13; hydrazine compounds described in U.S. Pat. No. 5,558,983, specifically, CA-1 to CA-6; and onium salts describedin JP-A-9-297368, specifically, A-1 to A-42, B-1 to B-27 and C-1 to C-14 and so forth may be used.

Formic acid and formic acid salts serve as a strongly fogging substance in a photothermographic material containing a non-photosensitive silver salt, a photosensitive silver halide and a binder. In the present invention, the photothgrmographic material preferably contains formic acid or a formic acid salt on the side having the image-forming layer containing a photosensitive silver halide in an amount of 5 mmol or less, more preferably 1 mmol or less, per 1 mole of silver.

In the photothermographic material the present invention, an acid formed by hydration of diphosphorus pentoxide or a salt thereof is preferably used together with the nucleating agent. Examples of the acid formed by hydration of diphosphorus pentoxide or a salt thereof include metaphosphoric acid (salt), pyrophosphoric acid (salt), orthophosphoric acid (salt), triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt) Specific examples of the salt are sodium orthophosphate, sodium dihydrogenorthophosphate, sodium hexametaphosphate, ammonium hexametaphosphate and so forth.

The acid formed by hydration of diphosphorus pentoxide or a salt thereof that can be preferably used in the present invention is added to the image-forming layer or a binder layer adjacent thereto in order to obtain the desired effect with a small amount of the acid or a salt thereof.

The acid formed by hydration of diphosphorus pentoxide or a salt thereof may be used in a desired amount (coated amount per $m^2$ of the phototherinographic material) depending on the desired performance including sensitivity and fog. However, it can preferably be used in an amount of 0,1–500 $mg/m^2$, more preferably 0.5–100 $mg/m^2$.

The photothermographic material of the present invention preferably contains a reducing agent for the silver salt of an organic acid. The reducing agent for the silver salt of an organic acid may be any substance that reduces silver ion to metal silver, preferably such an organic substance. Conventional photographic developers such as phenidone, hydroquinone and catechol are useful, but a hindered phenol reducing agent is preferred. The reducing agent is preferably contained in an amount of from 5–50 mole %r more preferably from 10–40 mole %, per mole of silver on the side having the image-forming layer. The reducing agent may be added to any layer on the side having an image-forming layer. In the case of adding the reducing agent to a layer other than the image-forming layer, the reducing agent is preferably used in a slightly large amount of from 10–50 mole % per mole of silver. The reducing agent may also be a so-called precursor that is derived to effectively function only at the time of development.

For photothermographic materials using a silver salt of an organic acid, reducing agents of a wide range can be used, There can be used, for example, the reducing agents disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,679,426, 3,751,252, 3,751,255, 3,761,270, 3,782,949, 3,839,048, 3,928,686 and 5,464,738, German Patent No. 2,321,328, EP-A-692732 and so forth. Examples thereof include amidoximes such as phenylamidoxime, 2-thienylamidoxime and p-phenoxyphenylamidoxime; azines such as 4-hydroxy-3,5-di-methoxybenzaldehyde azine; combinations of an aliphatic carboxylic acid arylhydrazide with ascorbic acid such as a combination of 2,2-bis(hydroxymethyl) propionyl-β-phenylhydrazine with ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzene-sulfonamidophenol; α-cyanophenylacetic acid derivatives such as ethyl-α-cyano-2-methylphenylacetate and ethyl-α-cyanophenyl-acetate; bis-β-naphthols such as 2,2'-dihydroxy-1,1'-bi-napththyl, 6,6'-dibromo-2,2'-dihydroxy-1,1'-binaphthyl and bis(2-hydroxy-1-naphthyl) methane; combinations of a bis-β-naphthol with a 1,3-dihydroxybenzene derivative (e.g., 2,4-dihydroxybenzophenone, 2',4'-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol 2-phenylindane-1,3-diones; chromans such as 2,2-dimethyl-7-tert-butyl-6-hydroxychroman; 1,4-dihydropyridines such as 2,6-dimethoxy-3,5-dicarboethoxy-1,4-dihydro-pyridine; bisphenols such as bis(2-hydroxy-3-tert-butyl-5-methylhenyl)methane, 2,2-bis (4-hydroxy-3-methylphenyl) propane, 4,4-ethylidene-bis (2-tert-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; chromanols such as tocopherol and so forth. Particularly preferred reducing agents are bisphenols and chromanols.

When the reducing agent is used in the present invention, it may be added in any form of aqueous solution, solution in an organic solvent, powder, solid microparticle dispersion, emulsion dispersion or the like. The solid microparticle dispersionisperformedbyusinga known pulverizingmeans (e.g., ball mill, vibrating ball mill, sandmill, colloid mill, jet mill, roller mill). At the time of solid microparticle dispersion, a dispersion aid may also be used.

When an additive known as "toning agent" capable of improving images is added, the optical density increases in some cases. The toning agent may also be advantageous in forming a black silver image depending on the case. The toning agent is preferably contained in a layer on the side having the image-forming layer in an amount of from 0.1–50 mole %, more preferably from 0.5–20 mole %, per mole of silver. The toning agent may be a so-called precursor that is derived to effectively function only at the time of development.

For photothermographic materials using a silver salt of an organic acid, toning agents of a wide range can be used. For example, there can be used toning agents disclosed in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Patent No. 1,380,795, Belgian Patent No. 841910 and so forth. Specific examples of the toning agent include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl) aryldicarboxyimides such as N,N-(dimethylaminomethyl) phthalimide and N,N-(dimethylamino-methyl)naphthalene-2,3-dicarboxyimide; blocked pyrazoles, isothiuronium derivatives and a certain kind of photobleaching agents such as N,N'-hexamethylenebis(1-carbamoyl-3,5-di-methylpyrazole), 1,8-(3,6-diazaoctane)bis(isothiuroniumtri-fluoroacetate) and 2-(tribromomethylsulfonyl)benzothiazole; 3-ethyl-5-[(3-ethyl-2-benzothiazolinylidene)-1-methylethylid ene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazinone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride); phthalazine, phthalazine derivatives (e.g., 4-(1-naphthyl)phthalazine, 6-chlorophthalazine, 5,7-dimethoxyphthalazine, 6-isobutyl-phthalazine, 6-tert-butylphthalazine, 5,7-dimethylphthalazine, 2,3-dihydrophthalazine) and metal salts thereof; combinations of phthalazine or a derivative thereof and a phthalic acid derivative (e.g., phthalic acid, 4-methylphthalic acid, 4-nitrophthalic acid, tetrachlorophthalic acid anhydride); quinazolinedione, benzoxazine and naphthoxazine derivatives; rhodium complexes which function not only as a toning agent but also as a halide ion source for the formation of silver halide at the site, such as ammonium hexachlororhodate (III), rhodium bromide, rhodium nitrate and potassium hexachlororhodate (III); inorganic peroxides and persulfates such as ammonium disulfide peroxide and hydrogen peroxide; benzoxazine-2,4-diones such as 1,3-henzoxazin-2,4-dione, 8-methyl-1,3-benzoxazin-2,4-dione and 6-nitro-1,3-benzoxazin-2,4-dione; pyrimidines and asymmetric triazines such as 2,4-dihydroxpyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H, 4H-2,3a,5,6a-tetraazapentalene and so forth.

In the present invention, the phthalazine derivatives represented by the general formula (F) mentioned in Japanese Patent Application No. 10-213478 are preferably used as the toning agent. Specifically, A-1 to A-10 mentioned in the same are preferably used.

The toning agent may be added in any form of solution, powder, solid microparticle dispersion or the like. The solid microparticle dispersion is performed by using known pulverization means (e.g., ball mill, vibrating ball mill, sand mill, colloid mill, jet mill, roller mill). At the time of solid microparticle dispersion, a dispersion aid may also be used.

The photothermographic material of the present invention preferably has a film surface pH of 6.0 or less, more preferably 5.5 or less before heat development. While it is not particularly limited as for the lower limit, it is normally around 3 or higher.

For controlling the film surface pH, an organic acid such as phthalic acid derivatives or a nonvolatile acid such as sulfuric acid, and a volatile base such as ammonia are preferably used to lower the film surface pH. In particular, ammonia is preferred to achieve a low film surface pH, because it is highly volatile and therefore it can be removed before coating or heat development. A method for measuring the film surface pH is described in Japanese Patent Application No. 11-87297, paragraph 0123.

The silver halide emulsion and/or the silver salt of an organic acid for use in the photothermographic material of the present invention can be further prevented from the generation of additional fog or stabilized against the reduction in sensitivity during the stock storage, by an antifoggant, a stabilizer or a stabilizer precursor. Examples of suitable antifoggant, stabilizer and stabilizer precursor that can be used individually or in combination include the thiazonium salts described in U.S. Pat. Nos, 2,131,028 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechols described in U.S. Pat. No. 3,235,652, oximes, nitrons and nitroindazoles described in British Patent No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, phosphorus compounds described in U.S. Pat. No. 4,411,985 and so forth.

The photothermographic material of the present invention may contain a benzoic acid compound for the purpose of achieving high sensitivity or preventing tog. The benzoic acid compound for use in the present invention may be any benzoic acid derivative, but preferred examples thereof include the compounds described in U.S. Pat. Nos. 4,784,939 and 4,152,160 and JP-A-9-329863, JP-A-9-329864 and JP-A-9-281637. The benzoic acid compound for use in the present invention may be added to any layer of the photothermographic material, but the layer to which the benzoic acid is added is preferably a layer on the surface having the image-forming layer, more preferably a layer containing a silver salt of an organic acid. The benzoic acid compound may be added at any step during the preparation of the coating solution. In the case of adding the benzoic acid compound to a layer containing a silver salt of an organic acid, it may be added at any step from the preparation of the silver salt of an organic acid to the preparation of the coating solution, but it is preferably added in the period after the preparation of the silver salt of an organic acid and immediately before the coating. The benzoic acid compound maybe added in any form such as powder, solution and microparticle dispersion, or may be added as a solution containing a mixture of the benzoic acid compound with other additives such as a sensitizing dye, reducing agent and toning agent, The benzoic acid compound may be added in any amount. However, the addition amount thereof is preferably from $1\times10^{-6}$ to 2 mole, more preferably from $1\times10^{-3}$ to 0.5 mole, per mole of silver.

Although not essential for practicing the present invention, it is advantageous in some cases to add a mercury (II) salt as an antifoggant to the image-forming layer. Preferred mercury(II) salts for this purpose are mercury acetate and mercury bromide. The addition amount of mercury for use in the present invention is preferably from $1\times10^{-9}$ to $1\times10^{-3}$ mole, more preferably from $1\times10^{-8}$ to $1\times10^{-4}$ mole, per mole of coated silver.

The antifoggant that is particularly preferably used in the present invention is an organic halide, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and 5,464,737.

The hydrophilic organic halides represented by the formula (P) mentioned in Japanese Patent Application No. 11-87297 can be preferably used as the antifoggant. Specifically, the compounds (P-1) to (P-118) mentioned in the same are preferably used.

The amount of the organic halides is preferably $1\times10^{-5}$ mole to 2 mole/mole Ag, more preferably $5\times10^{-5}$ mole to 1 mole/mole Ag, further preferably $1\times10^{-4}$ mole to $5\times10^{31\ 1}$ mole/mole Ag, in terms of molar amount per mole of Ag (mole/mole Ag). The organic halides may be used each alone, or two or more of them may be used in combination.

Further, the salicylic acid derivatives represented by the formula (Z) mentioned in Japanese Patent Application No.

11-87297 can be preferably used as the antifoggant. Specifically, the compounds (A-1) to (A-60) mentioned in the same are preferably used. The amount of the salicylic acid represented by the formula (z) is preferably $1\times10^{31\ 5}$ mole to $5\times10^{-1}$ mole/mole Ag, more preferably $5\times10^{-5}$ mole to $1\times10^{-1}$ mole/mole Ag, further preferably $1\times10^{-4}$ mole to $5\times10^{-2}$ mole/mole Ag, in terms of molar amount per mole of Ag (mole/mole Ag). The salicylic acid derivatives may be used each alone, or two or more of them may be used in combination.

As antifoggants preferably used in the present invention, formalin scavengers are effective. Examples thereof include the compounds represented by the formula (S) and the exemplary compounds thereof (S-1) to (S-24) mentioned in Japanese Patent Application No. 11-23995.

The antifoggants used for the present invention may be used after being dissolved in an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Further, they may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, they may be used by dispersing powder of them in a suitable solvent such as water using a ball mill, colloid mill, sand grinder mill, MANTON GAULIN, microfluidizer, or by means of ultrasonic wave according to a known method for solid dispersion.

While the antifoggants used in the present invention may be added to any layer on the image-forming layer side, that is, the image-forming layer or another layer on that side, they are preferably added to the image-forming layer or a layer adjacent thereto. The image-forming layer is a layer containing a reducible silver salt (silver salt of an organic acid), preferably such a image-forming layer further containing a photosensitive silver halide.

The photothermographic material of the present invention may contain a mercapto compound, disulfide compound or thione compound so as to control the development by inhibiting or accelerating the development or improve the storage stability before or after the development.

In the case of using a mercapto compound in the present invention, any structure may be used but those represented by Ar—SM or Ar—S—S—Ar are preferred, wherein M is hydrogen atom or an alkali metal atom, and Ar is an aromatic ring or condensed aromatic ring containing one or more nitrogen, sulfur, oxygen, selenium or tellurium atoms. The heteroaromatic ring is preferably selected from benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of a halogen (e.g., Br, Cl), hydroxy, amino, carboxy, alkyl (e g., alkyl having one or more carbon atoms, preferably from 1 to 4 carbon atoms), alkoxy (e.g., alkoxy having one or more carbon atoms, preferably from 1 to 4 carbon atoms) and aryl (which may have a substituent). Examples of the mercapto substituted heteroaromatic compound include 2-mercaptobenzimidazole, 2-mercaptobenzoxazole, 2-mercaptobenzothiazole, 2-mercapto-5-methylbenzinidazole, 6-ethoxy-2-mercaptobenzothiazole, 2,2'-dithiobis(benzothiazole), 3-mercapto-1,2,4-triazole, 4,5-di-phenyl-2-imidazolethiol, 2-mercaptoimidazole, 1-ethyl-2-mercaptobenzimidazole, 2-mercaptoquinoline, 8-mercaptopurine, 2-mercapto-4 (3H)-quinazolinone, 7-trifluoromethyl-4-quino-linethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-di-amino-2-mercaptopyrimidine, 2-mercapto-4-methyl-pyrimidine hydrochloride, 3-mercapto-5-phenyl-1,2,4-triazole, 1-phenyl-5-mercaptotetrazole, sodium 3-(5-mercaptotetrazole)benzene-sulfonate, N-methyl-N'-{3-(5-mercapotetrazolyl)phenyl}urea, 2-mercapto-4-phenyloxazole and so forth. However, the present invention is not limited to these.

The amount of the mercapto compound is preferably from 0.0001–1.0 mole, more preferably from 0.001–0.3 mole, per mole of silver in the image-forming layer.

The photothermographic material of the present invention has an image-forming layer containing a silver salt of an organic acid, a reducing agent and a photosensitive silver halide on a support, and at least one protective layer is preferably provided on the image-forming layer. Further, the photothermographic material of the present invention preferably has at least one back layer on the side of the support opposite to the side of the image-forming layer (back surface), and polymer latex is used as binder of the image-forming layer, protective layer and back layer. The use of polymer latex for these layers enables coating with an aqueous system utilizing a solvent (dispersion medium) containing water as a main component. Not only this is advantageous for environment and cost, but also it makes it possible to provide photothermographic materials that generate no wrinkle upon heat development. Further, by using a support subjected to a predetermined heat treatment, there are provided photothermographic materials exhibiting little dimensional change before and after the heat development.

As the binder used for the present invention, the polymer latex explained below is preferably used.

Among image-forming layers containing a photosensitive silver halide in the photothermographic material of the present invention, at least one layer is preferably an image-forming layer utilizing polymer latex to be explained below in an amount of 50 weight % or more with respect to the total amount of binder. The polymer latex may be used not only in the image-forming layer, but also in the protective layer, back layer or the like. When the photothermographic material of the present invention is used for, in particular, printing use in which dimensional change causes problems, the polymer latex is preferably used also in a protective layer and a back layer. The term "polymer latex" used herein means a dispersion comprising hydrophobic water-insoluble polymer dispersed in a water-soluble dispersion medium as fine particles. The dispersed state may be one in which polymer is emulsified in a dispersion medium, one in which polymer underwent emulsion polymerization, micelle dispersion, one in which polymer chains of polymer molecules having a hydrophilic portion are dispersed in molecular state or the like. The polymer latex used in the present invention is described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi KankoKai (1993);

Soichi Muroi, "Gosei Latex no Kagaku (Chemistry of Synthetic Latex)", Kobunshi Kanko Kai (1970) and so forth. The dispersed particles preferably have an average particle size of about 1–50000 nm, more preferably about 5–1000 nm. The particle size distribution of the dispersed particles is not particularly limited, and the particles may have either wide particle size distribution or monodispersed particle size distribution.

The polymer latex used in the present invention may be latex of the so-called core/shell type, which is different from ordinary polymer latex of a uniform structure. In this case, use of different glass transition temperatures of the core and shell may be preferred.

Preferred range of the glass transition temperature (Tg) of the polymer latex preferably used as the binder in the present invention varies for the protective layer, back layer and image-forming layer. As for the image-forming layer, the glass transition temperature is preferably −30–40° C. for accelerating diffusion of photographic elements during the heat development. Polymer latex used for the protective layer or back layer preferably has a glass transition temperature of 25–70° C., because these layers are brought into contact with various apparatuses.

The polymer latex used in the present invention preferably shows a minimum film forming temperature (MFT) of about −30–90° C., more preferably about 0–70° C. A film-forming aid may be added in order to control the minimum film forming temperature. The film-forming aid is also referred to as a plasticizer, and consists of an organic compound (usually an organic solvent) that lowers the minimum film forming temperature of the polymer latex. It is explained in, for example, the aforementioned Soichi Muroi, "Gosei Latex no Kagaku (Chemistry of Synthetic Latex)", Kobunshi Kanko Kai (1970).

Examples of polymer species used for the polymer latex used in the present invention include acrylic resins, polyvinyl acetate resins, polyester resins, polyurethane resins, rubber resins, polyvinyl chloride resins, polyvinylidene chloride resins and polyolefin resins, copolymers of monomers constituting these resins and so forth. The polymers may be linear, branched or crosslinked. They may be so-called homopolymers inwhicha single kind of monomers are polymerized, or copolymers in which two or more different kinds of monomers are polymerized. The copolymers may be random copolymers or block copolymers. The polymers may have a number average molecular weight of 5,000 to 1,000,000, preferably from 10,000 to 100,000. Polymers having a too small molecular weight may unfavorably provide insufficient mechanical strength of the image-forming layer, and those having a too large molecular weight may unfavorably provide bad film forming property.

Examples of the polymer latex used as the binder of the image-forming layer of the photothermographic material of the present invention include latex of methyl methacrylate/ethyl acrylate/methacrylic acid copolymer, latex of methyl methacrylate/butadiene/itaconic acid copolymer, latex of ethyl acrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chlcride(ethyl acrylate/acrylonitrile/methacrylic acid copolymer and so forth. More specifically, there can be mentioned latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate (95 weight %)/methacrylic acid (5 weight %) copolymer and so forth. Such polymers are also commercially available and examples thereof include acrylic resins such as CEBIAN A-4635, 46583, 4601 (all produced by Dicel Kagaku Kogyo Co., Ltd), Nipol LX811, 814, 821, 820, 857 (all produced by Nippon Zeon Co., Ltd.), VONCORT R3340, R3360, R3370, 4280 (all produced by Dai-Nippon Ink & Chemicals, Inc.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber resins such as LACSTAR 7310K, 3307B, 4700H, 7132C (all produced by Dai-Nippon Ink & Chemicals, Inc.), Nipol Lx416, 410, 438C (all produced by Nippon Zeon Co., Ltd.); polyvinyl chloride resins such as G351, G576 (both produced by Nippon Zeon Co., Ltd.); polyvinylidene chloride resins such as L502, L513 (both produced by Asahi Chemical Industry Co., Ltd.), ARON D7020, D504, D5071 (all produced by Mitsui Toatsu Co., Ltd.); and olefin resins such as CHEMIPEARL S120 and SA100 (both produced by Mitsui Petrochemical Industries, Ltd.) and so forth. These polymers may be used individually or, if desired, as a blend of two or more of them.

The image-forming layer preferably contains 50 weight % or more, more preferably 70 weight % or more, of the aforementioned polymer latex based on the total binder.

If required, the image-forming layer may contain a hydrophilic polymer in an amount of 50 weight % or less of the total binder, such as gelatin, polyvinyl alcohol, methylcellulose, hydroxypropylcellulose, carboxymethylcellulose and hydroxypropylmethylcellulose. The amount of the hydrophilic polymer is preferably 30 weight % or less, more preferably 15 weight % or less, of the total binder in the image-forming layer.

The image-forming layer is preferably formed by coating an aqueous coating solution and then drying the coating solution. The term "aqueous" as used herein means that water content of the solvent (dispersion medium) in the coating solution is 60 weight % or more. In the coating solution, the component other than water may be a water-miscible organic solvent such as methyl alcohol, ethyl alcohol, isopropyl alcohol, methyl cellosolve, ethyl cellosolve, dimethylformamide and ethyl acetate. Specific examples of the solvent composition include water/methanol=90/10, water/methanol=70/30, water/ethanol=90/10, water/isopropanol=90/10, water/dimethylformamide=95/5, water/methanol/dimethylformamide=80/15/5, and water/methanol/dimethylformamide=90/5/5 (the numerals indicate weight %).

The total amount of the binder in the image-forming layer is preferably 0.2–30 g/m$^2$, more preferably 1–15 g/m$^2$. The image-forming layer may contain a crosslinking agent for crosslinking, surfactant for improving coatability and so forth.

Further, a combination of polymer latexes having different I/O values is also preferably used as the binder of the protective layer. The I/O values are obtained by dividing an inorganicity value with an organicity value, both of which values are based on the organic conceptual diagram described in Japanese Patent Application No. 11-6872, paragraphs 0025–0029.

In the present invention, plasticizers described in Japanese Patent Application No. 11-143058, paragraphs 0021–0025 (e.g., benzyl alcohol, 2,2,4-trimethylpentanediol-1,3-monoisobutyrate etc.) Can be added to control the film-forming temperature as required. Further, a hydrophilic polymer may be added to a polymer binder, and a water-miscible organic solvent may be added to a coating solution as described in Japanese Patent Application No. 11-6872, paragraphs 0027–0028.

First polymer latex introduced with functional groups, and a crosslinking agent and/or second polymer latex having a functional group that can react with the first polymer latex, which are described in Japanese Patent Application No. 10-199626, paragraphs 0023–0041, can also be added to each layer.

The aforementioned functional groups may be selected from carboxyl group, hydroxyl group, isocyanate group, epoxy group, N-methylol group, oxazolinyl group and so forth. The crosslinking agent is selected fromepoxy compounds, isocyanate compounds, blocked isocyanate compounds, methylolated compounds, hydroxy compounds, carboxyl compounds, amino compounds, ethylene-imine compounds, aldehyde compounds, halogen compounds and so forth. Specific examples of the crosslinking agent include, as isocyanate compounds, hexamethylene isocyanate, Duranate WB40-80D, WX-1741 (Asahi Chemical Industry Co., Ltd.), Bayhydur 3100 (Sumitomo Bayer Urethane Co., Ltd.), Takenate WD725 (Takeda Chemical Industries, Ltd.), Aquanate 100, 200 (Nippon Polyurethane Industry Co., Ltd.), water dispersion type polyisocyanates mentioned in JP-A-9-160172; as an amino compound, Sumitex Resin M-3 (Sumitomo Chemical Co., Ltd.); as an epoxy compound, Denacol EX-614B (Nagase Chemicals Ltd.); as a halogen compound, 2,4-dichloro-6-hydroxy-1,3,5-triazine sodium salt and so forth.

The total amount of the binders for the image-forming layer is preferably in the range of 0.2–30 g/m$^2$, more preferably 1.0–15 g/m$^2$.

The total amount of the binders for the protective layer is preferably in the range of 0.2–10.0 g/m$^2$, more preferably 0.5–6.0 g/m$^2$.

The total amount of the binders for the back layer is preferably in the range of 0.01–10 g/m$^2$, more preferably 0.05–5.0 g/m$^2$.

Each of these layers may be provided as two or more layers. When the image-forming layer consists of two or more layers, it is preferred that polymer latex should be used as a binder for all of the layers. The protective layer is a layer provided on the image-forming layer, and it may consist of two or more layers. In such a case, it is preferred that polymer latex should be used for at least one layer, especially the outermost protective layer, Further, the back layer is a layer provided on an undercoat layer for the back surface of the support, and it may consist of two or more layers. In such a case, it is preferred that polymer latex should be used for at least one layer, especially the outermost back layer, A lubricant can be used in the photothermographic material of the present invention.

The lubricant used in the present specification means a compound which, when present on a surface of object, reduces the friction coefficient of the surface compared with that observed when the compound is absent. The type of the lubricant is not particularly limited.

Examples of the lubricant that can be used in the present invention include the compounds described in JP-A-11-84573, paragraphs 0061–0064 and Japanese Patent Application No. 11-106881, paragraphs 0049–0062.

Preferred examples of the lubricant include Cellosol 524 (main component: carnauba wax), Polyron A, 393, H-481 (main component: polyethylene wax), Himicron G-110 (main component: ethylene bisstearic acid amide), Himicron G-270 (main component: stearic acid amide) (all produced by Chukyo Yushi Co., Ltd.), W-1: $C_{16}H_{33}$—O—$SO_3Na$ W-2: $C_{18}H_{37}$—O—$SO_3Na$ and so forth.

The amount of the lubricant used is 0.1–50 weight %, preferably 0.5–30 weight %, of the amount of binder in a layer to which the lubricant is added.

In the present invention, when such development apparatuses as disclosed in Japanese Patent Application Nos. 11-346561 and 11-106881 are used, in which a photothermographic material is transported in a pre-heating section by facing rollers, and the material is transported in a heat development section by driving force of rollers facing the image-forming layer side of the material, while the opposite back surface slides on a smooth surface, ratio of friction coefficients of the outermost surface of the image-forming layer side of the material and the outermost surface of the back layer is 1.5 or more at the heat development temperature. Although the ratio is not particularly limited for its upper limit, it is about 30 or less. The value of $\mu b$ included in the following equation is 1.0 or less, preferably 0.05–0.8. The ratio can be obtained in accordance with the following equation. Ratio of friction coefficients=coefficient of dynamic friction between roller material of heat development apparatus and surface of image-forming layer side ($\mu e$)/coefficient of dynamic friction between material of smooth surface member of heat development apparatus and back surface ($\mu b$)

In the present invention, the lubricity between the materials of the heat development apparatus and the surface of image-forming layer side and/or the opposite back surface at the heat development temperature can be controlled by adding a lubricant to the outermost layers and adjusting its addition amount.

It is preferred that undercoat layers containing a vinylidene chloride copolymer comprising 70 weight % or more of repetition units of vinylidene chloride monomers should be provided on the both surfaces of the support. Such a vinylidene chloride copolymer is disclosed in JP-A-64-20544, JP-A1-180537, JP-A-1-209443, JP-A-1-285939, JP-A-1-296243, JP-A-2-24649, JP-A-2-24648, JP-A-2-184844, JP-A-3-109545, JP-A-3-137637, JP-A-3-141346, JP-A-3-141347, JP-A-4-96055, U.S. Pat. No. 4,645,731, JP-A-4-68344, Japanese Patent No. 2,557,641, page 2, right column, line 20to page 3, right column, line 30, Japanese Patent Application No. 10-221039, paragraphs 0020–0037, and Japanese Patent Application No. 11-106881, paragraphs 0063–0080.

If the vinylidene chloride monomer content is less than 70 weight %, sufficient moisture resistance cannot be obtained, and dimensional change with time after the heat development will become significant. The vinylidene chloride copolymer preferably contains repetition units of carboxyl group-containing vinyl monomers as constituent repetition units, besides the repetition units of vinylidene chloride monomer. A polymer consists solely of vinylidene chloride monomers crystallizes, and therefore it becomes difficult to form a uniform film when a moisture resistant layer is coated. Further, carboxyl group-containing vinyl monomers are indispensable for stabilizing the polymer. For these reasons, the repetition units of carboxyl group-containing vinyl monomers are added to the polymer.

The vinylidene chloride copolymer used in the present invention preferably has a molecular weight of 45,000 or less, more preferably 10,000–45,000, as a weight average molecular weight. When the molecular weight becomes large, adhesion between the vinylidene chloride copolymer layer and the support layer composed of polyester or the like tends to be degraded, The content of the vinylidene chloride copolymer used in the present invention is such an amount that the undercoat layers should have a thickness of 0.3 μm or more, preferably 0.3–4 μm, as a total thickness of the undercoat layers containing the vinylidene chloride copolymer for one side.

The vinylidene chloride copolymer layer as an undercoat layer is preferably provided as a first undercoat layer, which is directly coated on the support, and usually one vinylidene chloride copolymer layer is provided for each side. However, two or more of layers may be provided as the case may be. When multiple layers consisting of two or more layers are provided, the total amount of the vinylidene chloride copolymer in such layers may be within the range of the present invention defined above.

Such an undercoat layer may contain a crosslinking agent, matting agent or the like, in addition to the vinylidene chloride copolymer.

The support may be coated with an undercoat layer comprising SER, polyester, gelatin or the like as a binder, in addition to the vinylidene chloride copolymer layer, as required. The undercoat layer may have a multilayer structure, and may be provided on one side or both sides of the support. The undercoat layer generally has a thickness (per layer) of 0.01–5 μm, more preferably 0.05–1 μm, For the photothermographic material of the present invention, various kinds of supports can be used. Typical supports comprise polyester such as polyethylene terephthalate, and polyethylene naphthalate, cellulose nitrate, cellulose ester, polyvinylacetal, syndiotactic polystyrene, polycarbonate, paper support of which both surfaces are coated with polyethylene or the like. Among these, biaxially stretched polyester, especially polyethylene terephthalate (PET), is preferred in view of strength, dimensional stability, chemical resistance and so forth. The support preferably has a thickness of 90–180 μm as a base thickness except for the undercoat layers.

Preferably used as the support of the photothermographic material of the present invention is a polyester film, in particular polyethylene terephthalate film, subjected to a heat treatment in a temperature range of 130–185° C. in order to relax the internal distortion formed in the film during the biaxial stretching so that thermal shrinkage distortion occurring during the heat development could be eliminated. Such films are described in JP-A-10-48772, JP-A-10-10676, JP-A-10-10677, JP-A-11-65025 and JP-A-11-138648.

After such a heat treatment, the support preferably shows dimensional changes caused by heating at 120° C. for 30 seconds of −0.03% to +0.01% for the machine direction (MD) and 0 to 0.04% for the transverse direction (TD).

The photothermographic material of the present invention can be subjected to an antistatic treatment using the conductive metal oxides and/or fluorinated surfactants disclosed in JP-A-11-84573, paragraphs 0040–0051 for the purposes of reducing adhesion of dusts, preventing generation of static marks, preventing transportation failure during the automatic transportation and so forth. As the conductive metal oxides, the conductive acicular tin oxide doped with antimony disclosed in U.S. Pat. No. 5,575,957 and Japanese Patent Application No. 10-041302, paragraphs 0012–0020 and the fibrous tin oxide doped with antimony disclosed in JP-A-4-29134 can be preferably used.

The layer containing metal oxide should show a surface specific resistance (surface resistivity) of $10^{12}$ Ω or less, preferably $10^{11}$ Ω or less, in an atmosphere at 25° C. and 20% of relative humidity. Such a resistivity provides good antistatic property. Although the surface resistivity is not particularly limited as for the lower limit, it is usually about $10^{7}$ Ω or lower.

The photothermographic material of the present invention preferably has a Beck's smoothness of 2000 seconds or less, more preferably 10 seconds to 2000 seconds, as for at least one of the outermost surfaces of the image-forming layer side and the opposite side, preferably as for the both sides.

In the present invention, Beck smoothness can be easily determined according to Japanese Industrial Standard (JIS) P8119, "Test Method for Smoothness of Paper and Paperboard by Beck Test Device" and TAPPI Standard Method T479.

Beck smoothness of the outermost surfaces of the image-forming layer side and the opposite side of the photothermographic material can be controlled by suitably selecting particle size and amount of matting agent to be contained in the layers constituting the surfaces as described in JP-A-11-84573, paragraphs 0052–0059.

In the present invention, water-soluble polymers are preferably used as a thickener for imparting coating property. The polymers may be either naturally occurring polymers or synthetic polymers, and types thereof are not particularly limited. Specifically, there are mentioned naturally occurring polymers such as starches (corn starch, starch etc.), materials derive from seaweeds (agar, sodium arginate etc.), vegetable adhesive substances (gum arabic etc.), animal proteins (glue, casein, gelatin, egg white etc.) and adhesive fermentation products (pullulan, dextrin etc.), semi-synthetic polymers such as semi-synthetic starches (soluble starch, carboxyl starch, dextran etc.) and semi-synthetic celluloses (viscose, methylcellulose, ethylcellulose, carboxymethylcellulose, hydroxyethylcellulose, hydroxypropylcellulose, hydroxypropylmethylcellulose etc.), synthetic polymers (polyvinyl alcohol, polyacrylamide, polyvinylpyrrolidone, polyethylene glycol, polypropylene glycol, polyvinyl ether, polyethylene-imine, polystyrenesulfonic acid or styrenesulfonic acid copolymer, polyvinylslfanoic acid or vinylslfanoic acid copolymer, polyacrylic acid or acrylic acid copolymer, acrylic acid or acrylic acid copolymer, maleic acid copolymer, maleic acid monoester copolymer, polyacryloyl methylpropanesulfonate or acryloyl methylpropanesulfonate copolymer) and so forth.

Among these, water-soluble polymers preferably used are sodium arginate, gelatin, dextran, dextritnr methylcellulose, carboxymethylcellulose, hydroxyethylcellulose, hydroxypropylcellulose, polyvinyl alcohol, polyacrylamide, polyvinylpyrrolidone, polyethylene glycol, polypropylene glycol, polystyrenesulfonic acid or styrenesulfonic acid copolymer, polyacrylic acid or acrylic acid copolymer, maleic acid monoester copolymer, polyacryloylmethyl propanesulfonate or acryloylmethyl propanesulfonate copolymer, and they are particularly preferably used as a thickener.

Among these, particularly preferred thickeners are gelatin, dextran, methylcellulose, carboxymethylcellulose, hydroxyethylcellulose, polyvinyl alcohol, polyacrylamide, polyvinylpyrrolidone, polystyrenesulfonate or styrenesulfonate copolymer, polyacrylic acid or acrylic acid copolymer, maleic acid monoester copolymer and so forth. These compounds are described in detail in "Shin Suiyosei Polymer no Oyo to Shijo (Applications and Market of Water-soluble Polymers, New Edition)", CMC Shuppan, Inc., Ed. by Shinji Nagatomo, Nov. 4, 1988.

The amount of the water-soluble polymers used as a thickener is not particularly limited so long as viscosity is increased when they are added to a coating solution. Their concentration in the solution is generally 0.01–30 weight %, preferably 0,05–20 weight %, particularly preferably 0.1–10 weight %. Viscosity to be increased by the polymers is preferably 1–200 mPa·s, more preferably 5–100 mPa·s, as increased degree of viscosity compared with the initial viscosity. The viscosity is represented with values measured at 25° C. by using B-type rotational viscometer. Upon addition to a coating solution or the like, it is generally desirable that the thickener is added as a solution diluted as far as possible. It is also desirable to perform the addition with sufficient stirring.

Surfactants used in the present invention will be described below. The surfactants used in the present invention are classified into dispersing agents, coating agents, wetting agents, antistatic agents, photographic property controlling agents and so forth depending on the purposes of use thereof, and the purposes can be attained by suitably selecting surfactants from those described below and using them. As the surfactants used in the present invention, any of nonionic or ionic (anionic, cationic, betaine) surfactants can be used. Further, fluorinated surfactants can also be preferably used.

Preferred examples of the nonionic surfactant include surfactants having polyoxyethylene, polyoxypropylene, polyoxybutylene, polyglycidyl, sorbitan or the like as the nonionic hydrophilic group. Specifically, there can be mentioned polyoxyethylene alkyl ethers, polyoxyethylene alkyl phenyl ethers, polyoxyethylene/polyoxypropylene glycols, polyhydric alcohol aliphatic acid partial esters, polyoxyethylene polyhydric alcohol aliphatic acid partial esters, polyoxyethylene aliphatic acid esters, polyglycerin aliphatic acid esters, aliphatic acid diethanolamides, triethanolamine aliphatic acid partial esters and so forth.

Examples of anionic surfactants include carboxylic acid salts, sulfuric acid salts, sulfonic acid salts and phosphoric acid ester salts. Typical examples thereof are aliphatic acid salts, alkylbenzenesulfonates, alkylnaphthalenesulfonates, alkylsulfonates, a-olefinsulfonates, dialkylsulfosuccinates, α-sulfonated aliphatic acid salts, N-methyl-N-oleyltaurine, petroleum sulfonates, alkylsulfates, sulfated fats and oils, polyoxyethylene alkyl ether sulfates, polyoxyethylene alkyl phenyl ether sulfates, polyoxyethylene styrenylphenyl ether sulfates, alkyl phosphates, polyoxyethylene alkyl ether phosphates, naphthalenesulfonate formaldehyde condensates and so forth.

Examples of the cationic surfactants include amine salts, quaternary ammonium salts, pyridinium salts and so forth, and primary to tertiary amine salts and quaternary ammonium salts (tetraalkylammonium salts, trialkylbenzylammonium salts, alkylpyridinium salts, alkylimidazolium salts etc.) can be mentioned.

Examples of betaine type surfactants include carboxybetaine, sulfobetaine and so forth, and N-trialkyl-N-carboxymethylammonium betaine, N-trialkyl-N-sulfoalkyleneammonium betaine and so forth can be mentioned.

These surfactants are described in Takao Kariyone, "Kaimen Kasseizai no Oyo (Applications of Surfactants", Saiwai Shobo, Sep. 1, 1980). In the present invention, amounts of the preferred surfactants are not particularly limited, and they can be used in an amount providing desired surface activating property. The coating amount of the fluorine-containing surfactants is preferably 0.01–250 mg per 1 $m^2$.

Specific examples of the surfactants are mentioned below. However, the surfactants are not limited to these (—$C_6H_4$— represents phenylene group in the following formulas).

WA-1: $C_{16}H_{33}(OCH_2CH_2)_{10}OH$

WA-2: $C_9H_{19}$-$C_6H_4$-$(OCH_2CH_2)_{12}OH$

WA-3: Sodium dodecylbenzenesulfonate

WA-4: Sodium tri(isopropyl)naphthalenesulfonate

WA-5: Sodium tri(isobutyl)naphthalenesulfonate

WA-6: Sodium dodecylsulfate

WA-7: α-Sulfasuccinic acid di(2-ethylhexyl) ester sodium salt

WA-8: $C_8H_{17}$-$C_6H_4$-$(CH_2CH_2O)_3(CH_2)_2SO_3K$

WA-10: Cetyltrimethylarmonium chloride

WA-11: $C_{11}H_{23}CONHCH_2CH_2N^+(CH_3)_2$—$CH_2COO^-$

WA-12: $C_8F_{17}SO_2N(C_3H_7)(CH_2CH_2O)_{16}H$

WA-13: $C_8F_{17}SO_2N(C_3H_7)$ $CH_2COOK$

WA-14: $C_8F_{17}SO_3K$

WA-15: $C_8F_{17}SO_2N(C_3H_7)(CH_2CH_2O)_4(CH_2)_4SO_3Na$

WA-16: $C_8F_{17}SO_2N(C_3H_7)(CH_2)_3OCH_2CH_2N^+(CH_3)_3$—$CH_3$—$CH_6H_4$—$SO_3^-$

WA-17: $C_8F_{17}SO_2N(C_3H_7)$ $CH_2CH_2CH_2N^+(CH_3)_2$—$CH_2COO^-$

In a preferred embodiment of the present invention, an intermediate layer may be provided as required in addition to the image-forming layer and the protective layer. For improving the productivity or the like, it is preferred that these multiple layers should be simultaneously coated as stacked layers by using aqueous systems. While extrusion coating, slide bead coating, curtain coating and so forth can be mentioned as the coating method, the slide bead coating method shown in Japanese Patent Application No. 10-292849, FIG. 1 is particularly preferred.

Silver halide photographic materials utilizing gelatin as a main binder are rapidly cooled in a first drying zone, which is provided downstream from a coating dye. As a result, the gelatin gels and the coated film is solidified by cooling. The coated film that no longer flows as a result of the solidification by cooling is transferred to a second drying zone, and the solvent in the coating solution is evaporated in this drying zone and subsequent drying zones so that a film is formed. As drying method after the second drying zone, there can be mentioned the air loop method where a support supported by rollers is blown by air jet from a U-shaped duct, the helix method (air floating method) where the support is helically wound around a cylindrical duct and dried during transportation thereof and so forth.

When the layers are formed by using coating solutions comprising polymer latex as a main component of binder, the flow of the coating solution cannot be stopped by rapid cooling. Therefore, the predrying may be insufficient only with the first drying zone. In such a case, if such a drying method as utilized for silver halide photographic materials is used, uneven flow or uneven drying may occur, and therefore serious defects are likely to occur on the coated surface.

A preferred drying method for the present invention is such a method as described in Japanese Patent Application No. 10-292849, where the drying is attained in a horizontal drying zone irrespective of the drying zone, i.e., the first or second drying zone, at least until the constant rate drying is finished. The transportation of the support during the period immediately after the coating and before the support is introduced into the horizontal drying zone may be performed either horizontally or not horizontally, and the rising angle of the material with respect to the horizontal direction of the coating machine may be within the range of 0°-70°. Further, in the horizontal drying zone used in the present invention, the support may be transported at an angle within ±15° with respect to the horizontal direction of the coating machine, and it does not mean exactly horizontal transportation.

The constant rate drying used in the present invention means a drying process in which all entering calorie is consumed for evaporation of solvent at a constant liquid film temperature. Decreasing rate drying means a drying process where the drying rate is reduced by various factors (for example, diffusion of moisture in the material for moisture transfer becomes a rate-limiting factor, evaporation surface is recessed etc.) in an end period of the drying, and imparted calorie is also used for increase of liquid film temperature. The critical moisture content for the transition from the constant rate drying to the decreasing rate drying is 200–300%. When the constant rate drying is finished, the drying has sufficiently progressed so that the flowing could be stopped, and therefore such a drying method as used for silver halide photographic photosensitive materials may also be employable. In the present invention, however, it is preferred that the drying should be performed in a horizontal drying zone until the final drying degree is attained even after the constant rate drying.

As for the drying condition for forming the image-forming layer and/or protective layer, it is preferred that the liquid film surface temperature during the constant rate drying should be higher than minimum film forming temperature (MTF) of polymer latex (MTF is usually higher than glass transition temperature Tg of polymer by 3–5° C.). In many cases, it is usually selected from the range of 25–40° C., because of limitations imposed by production facilities. Further, the dry bulb temperature during the decreasing rate drying is preferably lower than Tg of the support (in the case of PET, usually 80° C. or lower). The liquid film surface temperature referred to in this specification means a solvent liquid film surface temperature of coated liquid film coated on a support, and the dry bulb temperature means a temperature of drying air blow in the drying zone.

If the constant rate drying is performed under a condition that lowers the liquid film surface temperature, the drying is likely to become insufficient. Therefore, the film-forming property of the protective layer is markedly degraded, and it becomes likely that cracks will be generated on the film surface, Further, film strength also becomes weak and thus it become likely that there arise serious problems, for example, the film becomes liable to suffer from scratches during transportation in a light exposure apparatus or heat development apparatus.

On the other hand, if the drying is performed under a condition that elevates the liquid film surface temperature, the protective layer mainly consisting of polymer latex rapidly becomes a film, but the under layers including the image-forming layer do not lose flowability, and hence it is likely that unevenness is formed on the surface. Furthermore, if the support (base) is subjected to a temperature higher than its Tg, dimensional stability and resistance to curl tendency of the photothermographic materials tend to be degraded.

The same is applied to the serial coating, in which an under layer is coated and then an upper layer is coated. As for properties of coating solutions, when an upper layer and a lower layer are coated as stacked layers and dried simultaneously by coating the upper layer before drying of the lower layer, in particular, a coating solution for the image-forming layer and a coating solution for protective layer preferably show a pH difference of 2.5 or less, and a smaller value of this pH difference is more preferred. If the pH difference becomes large, it becomes likely that microscopic aggregations are generated at the interface of the coating solutions and thus it becomes likely that serious defects of surface condition such as coating stripes occur during continuous coating for a long length.

The coating solution for the image-forming layer preferably has a viscosity of 15–100 mPa·S, more preferably 30–70 mPa·S, at 25° C. The coating solution for the protective layer preferably has a viscosity of 5–75 mPa·S, more preferably 20–50 mPa·S, at 25° C. These viscosities are measured by using a B-type viscometer.

The rolling up after the drying is preferably carried out under conditions of a temperature of 20–30° C. and a relative humidity of 45±20%. As for rolled shape, the material may be rolled so that the surface of the image-forming layer side may be toward the outside or inside of the roll according to a shape suitable for subsequent processing. Further, it is also preferred that, when the material is further processed in a rolled shape, the material should be rolled up into a shape of roll in which the sides are reversed compared with the original rolled shape during processing, in order to eliminate the curl generated while the material is in the original rolled shape. Relative humidity of the photothermographic material is preferably controlled to be in the range of 20–55% (measured at 25° C.).

In conventional coating solutions for photographic emulsions, which are viscous solutions containing silver halide and gelatin as a base, air bubbles are usually dissolved in the solutions and eliminated only by feeding the solutions by pressurization, and air bubbles are scarcely formed even when the solutions are placed under atmospheric pressure again for coating. However, as for the coating solution for the image-forming layer containing dispersion of silver salt of an organic acid, polymer latex and so forth preferably used in the present invention, only feeding of it by pressurization is likely to result in insufficient degassing. Therefore, it is preferably fed so that air/liquid interfaces could not be produced, while giving ultrasonic vibration to perform degassing.

In the present invention, the degassing of a coating solution is preferably performed by a method where the coating solution is degassed under reduced pressure before coating, and further the solution is maintained in a pressurized state at a pressure of 1.5 kg/cm or more and continuously fed so that air/liquid interfaces could not be formed, while giving ultrasonic vibration to the solution. Specifically, the method disclosed in JP-B-55-6405 (from page 4, line 20 to page 7, line 11) is preferred. As an apparatus for performing such degassing, the apparatus disclosed in Japanese Patent Application No. 10-290003, examples and FIG. 3, can be preferably used.

The pressurization condition is preferably 1.5 kg/cm$^2$ or more, more preferably 1.8 kg/cm$^2$ or more. While the pressure is not particularly limited as for its upper limit, it is usually about 5 kg/cm$^2$ or less. Ultrasonic wave given to the solution should have a sound pressure of 0.2 V or more, preferably 0.5–3.0 V. Although a higher sound pressure is generally preferred, an unduly high sound pressure provides high temperature portions due to caviatation, which may causes fogging. While frequency of the ultrasonic wave is not particularly limited, it is usually 10 kHz or higher, preferably 20 kHz to 200 kHz. The degassing under reduced pressure means a process where a coating solution is placed in a sealed tank (usually a tank in which the solution is prepared or stored) under reduced pressure to increase diameters of air bubbles in the coating solution so that degassing could be attained by buoyancy gained by the air bubbles. The reduced pressure condition for the degassing under reduced pressure is −200 mmHg or a pressure condition lower than that, preferably −250 mmHg or a pressure condition lower than that. Although the lower limit of the pressure condition is not particularly limited, it is usually about −800 mmHg or higher. Time under the reduced pressure is 30 minutes or more, preferably 45 minutes or more, and its upper limit is not particularly limited.

In the present invention, the image-forming layer, protective layer for the image-forming layer, undercoat layer and back layer may contain a dye in order to prevent halation and so forth as disclosed in JP-A-11-84573, paragraphs 0204–0208 and Japanese Patent Application No. 11-106881, paragraphs 0240–0241.

Various dyes and pigments can be used for the image-forming layer for improvement of color tone and prevention of irradiation. While arbitrary dyes and pigments may be used for the image-forming layer, the compounds disclosed in JP-A-11-119374, paragraphs 0297, for example, can be used. These dyes may be added in any form such as solution, emulsion, solid microparticle dispersion and macromolecule mordant mordanted with the dyes. Although the amount of these compounds is determined by the desired absorption, they are preferably used in an amount of $1\times10^{-6}$ g to 1 g per 1 $m^2$, in general.

When an antihalation dye is used in the present invention, the dye may be any compound so long as it shows intended absorption in a desired range and sufficiently low absorption in the visible region after development, and provides a preferred absorption spectrum pattern of the back layer. For example, the compounds disclosed in JP-A-11-119374, paragraph 0300 can be used, There can also be used a method of reducing density obtained with a dye by thermal decoloration as disclosed in Belgian Patent No. 733,706, a method of reducing the density by decoloration utilizing light irradiation as disclosed in JP-A-54-17833 and so forth.

When the photothermographic material of the present invention after heat development is used as a mask for the production of printing plates from PS plates, the photothermographic material after heat development carries information for setting up light exposure conditions of platemaking machine for PS plates or information for setting up platemaking conditions including transportation conditions of mask originals and PS plates as image information. Therefore, in order to read such information, densities (amounts) of the aforementioned irradiation dye, halation dye and filter dye are limited. Because the information is read by LED or laser, Dmin (minimum density) in a wavelength region of the sensor must be low, i.e., the absorbance must be 0.3 or less. For example, a platemaking machine S-FNRIII produced by Fuji Photo Film Co., Ltd. uses a light source havinga wavelength of 670 nm for a detector for detecting resister marks and a bar code reader. Further, platemaking machines of APML series produced by Shimizu Seisaku Co., Ltd. utilize a light source at 670 nm as a bar code reader. That is, if Dmin (minimum density) around 670 nm is high, the information on the film cannot be correctly detected, and thus operation errors such as transportation failure, light exposure failure and so forth are caused in platemaking machines. Therefore, in order to read information with a light source of 670 nm, Dmin around 670 nm must be low and the absorbance at 660–680 nm after the heat development must be 0.3 or less, more preferably 0.25 or less. Although the absorbance is not particularly limited as for its lower limit, it is usually about 0.10.

In the present invention, as the exposure apparatus used for the imagewise light exposure, any apparatus may be used so long as it is an exposure apparatus enabling light exposure with an exposure time of $10^{-7}$ second or shorter. However, a light exposure apparatus utilizing a laser diode (LD) or a light emitting diode (LED) as a light source is preferably used in general. In particular, LD is more preferred in view of high output and high resolution. Any of these light sources may be used so long as they can emit a light of electromagnetic wave spectrum of desired wavelength range. For example, as for LD, dye lasers, gas lasers, solid state lasers, semiconductor lasers and so forth can be used. Semiconductor lasers are particularly preferred, and specific examples thereof include those utilizing $In_{1-x}Ga_xP$ (about 700 nm), $GaAs_{1-x}P_x$ (610–900 nm), $Ga_{1-x}Al_xAs$ (690–900 nm), InGaAsP (1100–1670 nm), AlGaAsSb (1250–1400 nm) and so forth. Irradiation of light to the color photosensitive material of the present invention may also be performed by using, besides the aforementioned semiconductor lasers, a YAG laser in which Nb:YAG crystals are excited by $GaAs_xP_{1-x}$ light emitting diode. The use of light selected from the semiconductor laser light beams at wavelengths of 670, 680, 750, 780, 810 and 830 nm is preferred.

In the present invention, the second harmonics generating element (SHG element) means an element that converts wavelength of a laser ray to ½ by utilizing non-linear optical effect. Examples thereof include, for example, those utilizing CD*A or KD*P as non-linear optical crystals (see Laser Handbook, edited by the Laser Society of Japan, published on Dec. 15, 1982, pp.122–139). Further, an $LiNbO_3$ photoconductive waveguide element comprising $LiNbO_3$ crystals in which $Li^+$ is ion-exchanged with $H^+$ to form waveguide may also be used (see Nikkei Electronics, published on Jul. 14, 1986, No. 399, pp.89–90). The output device described in Japanese Patent Application No. 63-226552 can be used for the present invention.

The light exposure in the present invention is performed with overlapped light beams of light sources. The term "overlapped" means that a vertical scanning pitch width is smaller than the diameter of the beams. For example, the overlap can be quantitatively expressed as FWHM/vertical-scanning pitch width (overlap coefficient), where the beam diameter is represented as a half width of beam strength (FWHM). In the present invention, it is preferred that this overlap coefficient is 0.2 or more. Laser energy density on the surface of the photothermographic material surface is preferably several to several hundreds of microjoules ($\mu$J) per $cm^2$, more preferably several to several tens of microjoules per $cm^2$.

The scanning method of the light source of the light exposure apparatus used in the present invention is not particularly limited, and the cylinder external surface scanning method, cylinder internal surface scanning method, flat surface scanning method and so forth can be used. Although the channel of light source may be either single channel or multichannel, a multichannel comprising two or more of laser heads is preferred for the cylinder external surface scanning method.

The photothermographic material of the present invention shows low haze upon the light exposure, and therefore it is likely to generate interference fringes. As techniques for preventing such interference fringes, there are known a technique of obliquely irradiating a photothermographic material with a laser light as disclosed in JP-A-5-113548, a technique of utilizing a multimode laser as disclosed in WO95/31754 and so forth, and these techniques are preferably used.

Although any method may be used for the heat development process of the image-forming method used for the present invention, the development is usually performed by heating a photothermographic material exposed imagewise. As preferred embodiments of heat development apparatus to be used, there are heat development apparatuses in which a photothermographic material is brought into contact with a heat source such as heat roller or heat drum as disclosed in JP-B-5-56499, JP-A-9-292695, JP-A-9-297385 and WO95/30934, and heat development apparatuses of non-contact type as disclosed in JP-A-7-13294, WO97/28489, WO97/28488 and WO97/28487. Particularly preferred embodiments are the heat development apparatuses of non-contact type. The temperature for the development is preferably 80–250° C., more preferably 100–140° C. The development time is preferably 1–180 seconds, more preferably 5–90 seconds. The line speed is preferably 140 cm/minute or less.

As a method for preventing uneven development due to dimensional change of the photothermographic material during the heat development, it is effective to employ a method for forming images wherein the material is heated at a temperature of 80° C. or higher but lower than 115° C. for 5 seconds or more so as not to develop images, and then subjected to heat development at 110–140° C. to form images (so-called multi-step heating method).

Since the photothermographic material of the present invention is subjected to a high temperature of 110° C. or higher during the heat development, a part of the components contained in the material or a part of decomposition products produced by the heat development are volatilized. It is known that these volatilized components exert various bad influences, for example, they may cause uneven development, erode structural members of development apparatuses, deposit at low temperature portions as dusts to cause deformation of image surface, adhere to image surface as stains and so forth. As a method for eliminating these influences, it is known to provide a filter on the heat development apparatus, or optimally control air flows in the heat development apparatus. These methods may be effectively used in combination.

WO95/30933, WO97/21150 and International Patent Publication in Japanese (Kohyo) No. 10-500496 disclose use of a filter cartridge containing binding absorption particles and having a first vent for introducing volatilized components and a second vent for discharging them in heating apparatuses for heating photothermographic materials by contact. Further, WO96/12213 and International Patent Publication in Japanese (Kohyo) No. 10-507403 disclose use of a filter consisting of a combination of heat conductive condensation collector and a gas-absorptive microparticle filter. These can be preferably used in the present invention.

Further, U.S. Pat. No. 4,518,845 and JP-B-3-54331 disclose structures comprising means for eliminating vapor from a photothermographic material, pressing means for pressing the photothermographic material to a heat-conductive member and means for heating the heat-conductive member. Further, WO98/27458 discloses elimination of components volatilized from a photothermographic material and increasing fog from a surface of the photothermographic material, These techniques are also preferably used for the present invention.

An example of the structure of heat development apparatus used for the heat development of the photothermographic material of the present invention is shown in FIG. 1. FIG. 1 depicts a side view of a heat development apparatus. The heat development apparatus shown in FIG. 1 comprises carrying-in roller pairs 11 (upper rollers are silicone rubber rollers, and lower rollers are aluminum heating rollers), which carry a photothermographic material 10 into the heating section while making the material in a flat shape and preheating it, and carrying-out roller pairs 12, which carry out the photothermographic material 10 after heat development from the heating section while maintaining the material to be in a flat shape. The photothermographic material 10 is heat-developed while it is conveyed by the carrying-in roller pairs 11 and then by the carrying-out roller pairs 12. Conveying means for carrying the photothermographic material 10 under the heat development is provided with multiple rollers 13 so that they could be contacted with the surface of the image-forming layer side, and a flat surface 14 adhered with non-woven fabric (composed of, for example, aromatic polyamide, Teflon etc.) or the like is provided on the opposite side so that it could be contacted with the back surface. The photothermographic material 10 is conveyed by driving force of the multiple rollers 13 contacted with the image-forming layer side, while the back surface slides on the flat surface 14. Heaters 15 are provided over the rollers 13 and under the flat surface 14 so that the photothermographic material 10 could be heated from the both sides. Examples of the heating means include panel heaters and so forth, while clearance between the rollers 13 and the flat surface 14 may vary depending on the material of the flat surface member, it is suitably adjusted to a clearance that allows the conveyance of the photothermographic material 10. The clearance is preferably 0–1 mm.

The materials of the surfaces of the rollers 13 and the member of the flat surface 14 may be composed of any materials so long as they have heat resistance and they should not cause any troubles in the conveyance of the photothermographic material 10. However, the material of the roller surface is preferably composed of silicone rubber, and the member of the flat surface is preferably composed of non-woven fabric made of aromatic polyamide or Teflon (PTFE). The heating means preferably comprises multiple heaters so that temperature of each heater can be adjusted freely.

The heating section is constituted by a preheating section A comprising the carrying-in roller pairs 11 and a heat development section B comprising the heaters 15. Temperature of the preheating section A locating upstream from the heat development section B is preferably controlled to be lower than the heat development temperature (for example, lower by about 10–30° C.), and temperature and heat development time are desirably adjusted so that they could be sufficient for evaporating moisture contained in the photothermographic material 10. The temperature is also adjusted to be higher than the glass transition temperature (Tg) of the support of the photothermographic material 10 so that uneven development could be prevented. Temperature distribution of the preheating section and the heat development section is preferably ±1° C. or less, more preferably ±0.5° C. or less.

Moreover, guide panels 16 are provided downstream from the heat development section B, and they constitute a gradual cooling section C together with the carrying-out roller pairs 12.

The guide panels 16 are preferably composed of a material of low heat conductivity, and it is preferred that the cooling is performed gradually so as not to cause deformation of the photothermographic material 10. The cooling rate is preferably 0.5–10° C./second.

The heat development apparatus was explained with reference to the example shown in the drawing. However, the apparatus is not limited to the example. For example, the heat development apparatus used for the present invention may have a variety of structures such as one disclosed in JP-A-7-13294. For the multi-step heating method, which is preferably used for the present invention, the photothermographic material may be successively heated at different temperatures in such an apparatus as mentioned above, which is provided with two or more heat sources at different temperatures.

EXAMPLES

The present invention will be specifically explained with reference to the following examples. The materials, regents, ratios, procedures and so forth shown in the following examples can be optionally changed so long as such change does not depart from the spirit of the present invention. Therefore, the scope of the present invention is not limited by the following examples.

Example 1

<<Preparation of Silver Halide Emulsion A>>

In 700 ml of water, 11 g of alkali-treated gelatin (calcium content: 2700 ppm or less), 30 mg of potassium bromide and 1.3 g of sodium 4-methylbenzenesulfonate were dissolved. After the solution was adjusted to pH 6.5 at a temperature of 40° C., 159 ml of an aqueous solution containing 18.6 g of silver nitrate and an aqueous solution containing 1 mol/l of potassium bromide and $2\times10^{-5}$ mol/l of $K_3IrCl_6$ were added by the control double jet method over 6 minutes and 30 seconds while pAg was maintained at 7.7. Then, 476 ml of an aqueous solution containing 55.5 g of silver nitrate and a halide salt aqueous solution containing 1 mol/l of potassium bromide and $2\times10^{-5}$ mol/l of $K_3IrCl_6$ were added by the control double jet method over 28 minutes and 30 seconds while pAg was maintained at 7.7. Then, the pH was lowered to cause coagulation precipitation to effect desalting, 51.1 g of low molecular weight gelatin having an average molecular weight of 15,000 (calcium content: 20 ppm or less) was added, and pH and pAg were adjusted to 5.9 and 8.0, respectively The grains obtained were cubic grains having a mean grain size of 0.08 μm, variation coefficient of 9% for projected area and [100] face ratio of 90%.

The silver halide grains obtained as described above were added with 4-hydroxy-6-methyl-1,3,3a,7-tetrazaindene in an amount of $2\times10^{-5}$ per mole of silver, then added with a sensitizing dye shown in Table 1, and ripened at 70° C. for 30 minutes. Then, the temperature of the emulsion was lowered to 60° C., and the emulsion was added with 76 pmol per mole of silver of sodium benzenethiosulfonate. Three minutes later, the emulsion was added with 71 μmol of triethylthiourea, ripened for 100 minutes, added with $5\times10^{-4}$ mol of 4-hydroxy-6-methyl-1,3,3a,7-tetrazaindene and 0.17 g of Compound A, and cooled to 40° C. to complete the preparation of Silver halide emulsion A.

Compound A

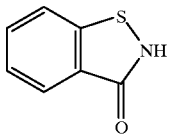

<<Preparation of Silver Behenate Dispersion A>>

In an amount of 87.6 kg of behenic acid (Edenor C22-85R, trade name, produced by Henkel Co.), 423 l of distilled water, 49.2 l of aqueous solution of NaOH at 5 mol/l concentration and 120 l of tert-butanol were mixed and allowed to react at 75° C. for one hour with stirring to obtain a solution of sodium behenate. Separately, 206.2 l of an aqueous solution containing 40.4 kg of silver nitrate was prepared and kept at 10° C. A mixture of 635 l of distilled water and 30 l of tert-butanol contained in a reaction vessel kept at 30° C. was added with the whole amount of the aforementioned sodium behenate solution and the whole amount of the aqueous silver nitrate solution with stirring at constant flow rates over the periods of 62 minutes and 10 seconds, and 60 minutes, respectively. In this operation, the aqueous silver nitrate solution was added in such a manner that only the aqueous silver nitrate solution should be added for 7 minutes and 20 seconds after starting the addition of the aqueous silver nitrate solution, and then the addition of the aqueous solution of sodium behenate was started and added in such a manner that only the aqueous solution of sodium behenate should be added for 9 minutes and 30 seconds after finishing the addition of the aqueous silver nitrate solution. During the addition, the temperature in the reaction vessel was set at 30° C. and controlled so as not to be raised. The piping of the addition system for the sodium behenate solution was warmed by steam trace and the amount of steam was controlled such that the liquid temperature at the outlet orifice of the addition nozzle should be 75° C. The piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions were controlled to be at heights for not contacting with the reaction mixture.

After finishing the addition of the sodium behenate solution, the mixture was left with stirring for 20 minutes at the same temperature and then the temperature was decreased to 25° C. Thereafter, the solid content was recovered by suction filtration and the solid content was washed with water until electric conductivity of the filtrate became 30 μS/cm. The solid content obtained as described above was stored as a wet cake without being dried.

When the shape of the obtained silver behenate grains was evaluated by an electron microscopic photography, the grains were scaly crystals having a mean diameter of projected areas of 0.52 μm, mean thickness of 0.14 μm and variation coefficient of 15% for mean diameter as spheres.

Then, dispersion of silver behenate was prepared as follows. To the wet cake corresponding to 100 g of the dry solid content was added with 7.4 g of polyvinyl alcohol (PVA-217, trade name, average polymerization degree: about 1700) and water to make the total amount 385 g, and the mixture was pre-dispersed by a homomixer. Then, the pre-dispersed stock dispersion was treated three times by using a dispersing machine (Microfluidizer-M-110S-EH; trade name, produced by Microfluidex International Corporation, using G10Z interaction chamber) with a pressure controlled to be 1750 kg/cm$^2$ to obtain Silver behenate dispersion A. During the cooling operation, a desired dispersion temperature was achieved by providing coiled heat exchangers fixed before and after the interaction chamber and controlling the temperature of the refrigerant.

The silver behenate grains contained in Silver behenate dispersion A obtained as described above were grains having a volume weight mean diameter of 0.52 μm and variation coefficient of 15%. The measurement of the grain size was carried out by using Master Sizer X produced by Malvern Instruments Ltd. When the grains were evaluated by an electron microscopic photography, the ratio of the long side to the short side was 1.5, the grain thickness was 0.14 μm, and a mean aspect ratio (ratio of diameter as sphere of projected area of grain and grain thickness) was 5.1.

<<Preparation of Solid Microparticle Dispersion of Reducing Agent A>>

In an amount of 10 kg of Reducing agent A [1,1-bis(2-hydroxy-3,5-dimethylphenyl)-3,5,5-trimethylhexane] and 10 kg of 20 weight % aqueous solution of denatured polyvinyl alcohol (Poval MP203, produced by Kuraray Co. Ltd.) were added with 400 g of Safinol 104E (Nisshin Kagaku Co.), 640 g of methanol and 16 kg of water, and mixed sufficiently to form slurry. The slurry was fed by a diaphragm pump to a sand mill of horizontal type (UVM-2, produced by Imex Co.) containing zirconia beads having a mean diameter of 0.5 mm, and dispersed for 3 hours and 30 minutes. Then, the slurry was added with 4 g of benzothiazolinone sodium salt and water so that the concentration of the reducing agent could become 25 weight % to obtain a solid microparticle dispersion of reducing agent. The reducing agent particles contained in the dispersion obtained as described above had a median diameter of 0.44 μm, maximum particle diameter of 2.0 μm or less and variation coefficient of 19% for mean particle diameter. The obtained dispersion was filtered through a polypropylene filter having a pore size of 3.0 μm to remove dusts and so forth, and stored.

<<Preparation of Solid Microparticle Dispersion of Organic Polyhalogenated Compound A>>

In an amount of 10 kg of Organic polyhalogenated compound A [tribromomethyl(4-(2,4,6-trimethylphenylsulfonyl)phenyl)-sulfone], 10 kg of 20 weight % aqueous solution of denatured polyvinyl alcohol (Poval MP203, produced by Kuraray Co. Ltd.), 639 g of 20 weight % aqueous solution of sodium triisopropylnaphthalenesulfonate, 400 g of Safinol 104E (Nisshin Kagaku Co.), 640 g of methanol and 16 kg of water were mixed sufficiently to form slurry. The slurry was fed by a diaphragm pump to a sand mill of horizontal type (UVM-2, produced by Imex Co.) containing zirconia beads having a mean diameter of 0.5 mm, and dispersed for 5 hours. Then, the slurry was added with water so that the concentration of Organic polyhalogenated compound A could become 25 weight % to obtain solid microparticle dispersion of Organic polyhalogenated compound A. The particles of the organic polyhalogenated compound contained in the dispersion obtained as described above had a median diameter of 0.36 μm, maximum particle diameter of 2.0 μm or less and variation coefficient of 18% for mean particle diameter. The obtained dispersion was filtered through a polypropylene filter having a pore size of 3.0 μm to remove dusts and so forth, and stored.

<<Preparation of Solid Microparticle Dispersion of Organic Polyhalogenated Compound B>>

In an amount of 5 kg of Organic polyhalogenated compound B [tribromomethylnaphthylsulfone], 2.5 kg of 20 weight % aqueous solution of denatured polyvinyl alcohol (Poval MP203, produced by Kuraray Co. Ltd.), 213 g of 20 weight % aqueous solution of sodium triisopropylnaphthalenesulfonate and 10 kg of water were mixed sufficiently to form slurry. The slurry was fed by a diaphragm pump to a sand mill of horizontal type (UVM-2, produced by Imex Co.) containing zirconia beads having a mean diameter of 0.5 mm, and dispersed for 5 hours. Then, the slurry was added with 2.5 g of benzothiazolinone sodium salt and water so that the concentration of Organic polyhalogenated compound B could become 20 weight % to obtain solid microparticle dispersion of Organic polyhalogenated compound B. The particles of the organic polyhalogenated compound contained in the dispersion obtained as described above had a median diameter of 0.38 μm, maximum particle diameter of 2.0 μm or shorter and variation coefficient of 20% for mean particle diameter. The obtained dispersion was filtered through a polypropylene filter having a pore size of 3.0 μm to remove dusts and so forth, and stored.

<<Preparation of Aqueous Solution of Organic Polyhalogenated Compound C>>

In an amount of 75.0 ml of water, 8.6 ml of 20 weight % aqueous solution of sodium triisopropylnaphthalenesulfonate, 6.8 ml of 5 weight % aqueous solution of sodium dihydrogen-orthophosphate dihydrate and 9.5 ml of 1 mol/l aqueous solution of potassium hydroxide were successively added at room temperature with Stirring, and the mixture was stirred for 5 minutes after the addition was completed. Further, the mixture was added with 4.0 g of Organic polyhalogenated compound C [3-tribromomethanesulfonylbenzoylaminoacetic acid] as powder and it was dissolved until the solution became transparent to obtain 100 ml of aqueous solution of Organic polyhalogenated compound C. The obtained aqueous solution was filtered through a polyester screen of 200 mesh to remove dusts and so forth, and stored.

<<Preparation of Emulsion Dispersion of Compound Z>>

In an amount of 10 kg of R-054 (Sanko Co., Ltd.) containing 85 weight % of Compound Z was mixed with 11.66 kg of MIBK and dissolved in the solvent at 80° C. for 1 hour in an atmosphere substituted with nitrogen. This solution was added with 25.52 kg of water, 12.76 kg of 20 weight % aqueous solution of MP polymer (MP-203, produced by Kuraray Co. Ltd.) and 0.44 kg of 20 weight % aqueous solution of sodium triisopropylnaphthalenesulfonate and subjected to emulsion dispersion at 20–40° C. and 3600 rpm for 60 minutes. The dispersion was further added with 0.08 kg of Safinol 104E (Nisshin Kagaku Co.) and 47.94 kg of water and distilled under reduced pressure to remove MIBK. Then, the concentration of Compound Z was adjusted to 10 weight %. The particles of Compound Z contained in the dispersion obtained as described above had a median diameter of 0.19 μm, maximum particle diameter of 1.5 μm or less and variation coefficient of 17% for mean particle diameter. The obtained dispersion was filtered through a polypropylene filter having a pore size of 3.0 μm to remove dusts and so forth, and stored.

<<Preparation of Dispersion of 6-isopropylphthalazine Compound>>

In an amount of 62.35 g of water was added with 2.0 g of denatured polyvinyl alcohol (Poval MP203, produced by Kuraray Co., Ltd.) with stirring so that the denatured polyvinyl alcohol could not coagulate, and mixed by stirring for 10 minutes. Then, the mixture was heated until the internal temperature reached 65° C., and stirred for 90 minutes to attain uniform dissolution. The internal temperature was lowered to 40° C. or lower, and the mixture was added with 25.5 g of 10 weight % aqueous solution of polyvinyl alcohol (PVA-217, produced by Kuraray Co., Ltd.), 3.0 g of 20 weight % aqueous solution of sodium triisopropylnaphthalenesulfonate and 7.15 g of 6-isopropylphthalazine (70% aqueous solution) and stirred for 30 minutes to obtain 100 g of transparent dispersion. The obtained dispersion was filtered through a polypropylene filter having a pore size of 3.0 μm to remove dusts and so forth, and stored.

<<Preparation of Solid Microparticle Dispersion of Nucleating Agent Y>>

In an amount of 4 kg of Nucleating agent Y was added with 1 kg of Poval PVA-217 (produced by Kuraray Co., Ltd.) and 36 kg of water, and mixed sufficiently to form slurry. The slurry was fed by a diaphragm pump to a sand mill of horizontal type (UVM-2, produced by Imex Co.) containing zirconia beads having a mean diameter of 0.5 mm, and dispersed for 12 hours. Then, the slurry was added with 4 g of benzothiazolinone sodium salt and water so that the concentration of Nucleating agent Y could become 10 weight % to obtain solid microparticle dispersion of Nucleating agent Y. The particles of the nucleating agent contained in the dispersion obtained as described above had a median diameter of 0.34 μm, maximum particle diameter of 3.0 μm or less, and variation coefficient of 19% for the particle diameter. The obtained dispersion was filtered through a polypropylene filter having a pore size of 3.0 μm to remove dusts and so forth, and stored.

<<Preparation of Coating Solution for Image-Forming Layer>>

Silver behenate dispersion A prepared above was added with the following binder, components and Silver halide emulsion A in the indicated amounts per mole of silver in Silver behenate dispersion A, and added with water to prepare a coating solution for image-forming layer. After the completion, the solution was degassed under reduced pressure of 0.54 atm for 45 minutes. The coating solution showed pH of 7.3–7.7 and viscosity of 40–50 mPa·s at 25° C.

| | |
|---|---|
| Binder: LACSTAR 3307B (SER latex, produced by Dai-Nippon Ink & Chemicals, Inc., glass transition temperature: 17° C.) | 397 g as solid |
| Reducing agent A | 149 g as solid |
| Organic polyhalogenated compound A | 43.6 g as solid |
| Organic polyhalogenated compound B | 13.8 g as solid |
| Organic polyhalogenated compound C | 2.25 g as solid |
| Sodium ethylthiosulfonate | 0.47 g |
| Benzotriazole | 1.02 g |
| Polyvinyl alcohol (PVA-235, produced by Kuraray Co., Ltd.) | 10.8 g |
| 6-Isopropylphthalazine | 17.0 g |
| Compound Z | 9.7 g as solid |
| Nucleating agent Y | 15.3 g as solid |
| Dye A (added as a mixture with low molecular weight gelatin having mean molecular weight of 15000) | Amount giving optical density of 0.15 at 783 nm (about 0.19 g) |
| Silver halide emulsion A | 0.06 mole as Ag |
| Compound A as preservative | 40 ppm in the coating solution (2.5 mg/m$^2$ as coated amount) |
| Methanol | 2 weight % as to total solvent amount in the coating solution |
| Ethanol | 1 weight % as to total solvent amount in the coating solution |

(The coated film showed a glass transition temperature of 17° C.)

-continued

Compound Z

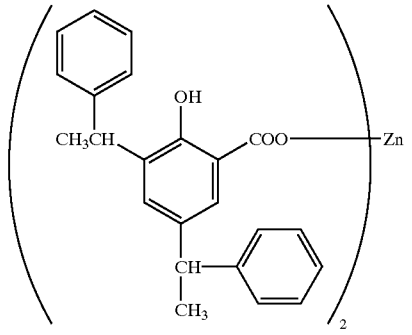

Nucleating agent Y

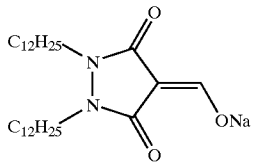

Dye A

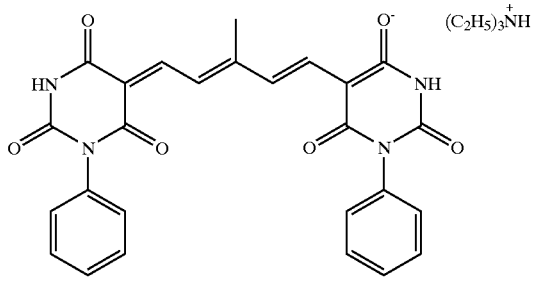

<<Preparation of Coating Solution for Lower Protective Layer>>

In an amount of 943 g of a polymer latex solution containing copolymer of methyl methacrylate/styrene/2-ethyl-hexyl acrylate/2-hydroxyethyl methacrylate/acrylic acid=58.9/8.6/25.4/5.1/2 (weight %) (glass transition temperature as copolymer: 46° C. (calculated value), solid content: 21.5 weight %, containing 100 ppm of Compound A and further containing Compound D as a film-forming aid in an amount of 15 weight % relative to solid content of the latex so that the glass transition temperature of the coating solution could become 24° C., mean particle diameter: 116 nm) was added with water, 1.62 g of Compound E, 112.7 g of the aqueous solution of Organic polyhalogenated compound C, 11.54 g as solid content of Development accelerator A, 1.58 g of matting agent (polystyrene particles, mean particle diameter: 7 μm, variation coefficient of 8% for mean particle diameter) and 29.4 g of polyvinyl alcohol (PVA-235, Kuraray Co., Ltd.) and further added with water to form a coating solution (containing 2 weight % of methanol solvent). After the completion, the solution was degassed under reduced pressure of 0.47 atm for 60 minutes. The coating solution showed pH of 5.4, and viscosity of 39 mPa·s at 25° C.

<<Preparation of Coating Solution for Upper Protective Layer>>

In an amount of 649 g of a polymer latex solution containing copolymer of methyl methacrylate/styrene/2-ethyl-hexyl acrylate/2-hydroxyethyl methacrylate/acrylic acid=58.9/8.6/25.4/5.1/2 (weight %) (glass transition temperature as copolymer: 46° C. (calculated value), solid content: 21.5 weight %, containing 100 ppm of Compound A and further containing Compound D as a film-forming aid in an amount of 15 weight % relative to solid content of the latex so that the glass transition temperature of the coating solution could become 24° C., mean particle diameter: 72 nm) was added with water, 6.30 gof 30 weight % solution of carnauba wax (Cellosol 524, silicone content: less than 5 ppm, Chukyo Yushi Co., Ltd.), 0.23 g of Compound C, 0.93 g of Compound E, 7.95 g of Compound F, 1.8 g of Compound H, 1.18 g of matting agent (polystyrene particles, mean particle diameter: 7 μm, variation coefficient of 8% for mean particle diameter) and 12.1 g of polyvinyl alcohol (PVA-235, Kuraray Co., Ltd.), and further added with water to form a coating solution (containing 1.5 weight % of methanol solvent). After the completion, the solution was degassed under reduced pressure of 0.47 atm for 60 minutes. The coating solution showed pH of 2.8, and viscosity of 30 mPa·s at 25° C.

Development accelerator A

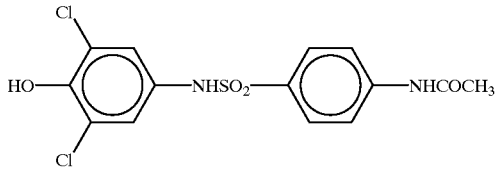

Compound C

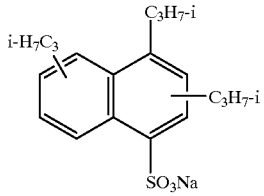

Compound D

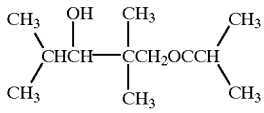

Compound E

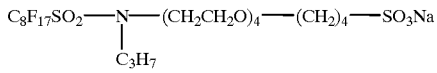

Compound F

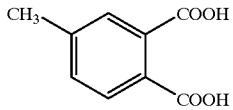

Compound H

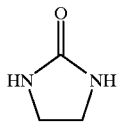

<<Preparation of Polyethylene Terephthalate (PET) Support with Back Layers and Undercoat Layers>>

(1) Preparation of PET Support

Polyethylene terephthalate having TV (intrinsic viscosity) of 0.66 (measured in phenol/tetrachloroethane=6/4 (weight ratio) at 25° C.) was obtained in a conventional manner by using terephthalic acid and ethylene glycol. The product was pelletized, dried at 130° C. for 4 hours, melted at 3° C., then extruded from a T-die and rapidly cooled to form an unstretched film having such a thickness that the film should have a thickness of 120 μm after thermal fixation.

The film was stretched along the longitudinal direction by 3.3 times using rollers of different peripheral speeds, and then stretched along the transverse direction by 4.5 times using a tenter. The temperatures used for these operations were 110° C. and 130° C. respectively. Then, the film was subjected to thermal fixation at 240° C. for 20 seconds, and relaxed by 4% along the transverse direction at the same temperature, Then, the chuck of the tenter was released, the both edges of the film were knurled, and the film was rolled up at 4.8 kg/cm$^2$. Thus, a roll of a PET support having a width of 2.4 m, length of 3500 m, and thickness of 120 μm was obtained.

(2) Preparation of Undercoat Layers and Back Layers (2-1) First Undercoat Layer

The aforementioned PET support was subjected to a corona discharge treatment of 0.375 kV·A·minute/m$^2$, then coated with a coating solution having the following composition in an amount of 6.2 ml/m$^2$, and dried at 125° C. for 30 seconds, 150° C. for 30 seconds, and 185° C. for 30 seconds.

| | |
|---|---|
| Latex A | 280 g |
| KOH | 0.5 g |
| Polystyrene microparticles (mean particle diameter; 2 μm, variation coefficient of 7% for mean particle diameter) | 0.03 g |
| 2,4-Dichloro-6-hydroxy-s-triazine | 1.8 g |
| Compound Bc-C | 0.097 g |
| Distilled water | Amount giving total weight of 1000 g |

(2-2) Second undercoat layer

A coating solution having the following composition was coated on the first undercoat layer in an amount of 5.5 ml/m$^2$ and dried at 125° C. for 30 seconds, 150° C. for 30 seconds, and 170° C. for 30 seconds.

| | |
|---|---|
| Deionized gelatin ($Ca^{2+}$ content; 0.6 ppm, jelly strength; 230 g) | 10.0 g |
| Acetic acid (20% aqueous solution) | 10.0 g |
| Compound Bc-A | 0.04 g |
| Methylcellulose (2% aqueous solution) | 25.0 g |
| Emalex 710 (produced by Nihon Emulsion Co.) | 0.3 g |
| Distilled water | Amount giving total weight of 1000 g |

(2-2) Second Undercoat Layer

A coating solution having the following composition was coated on the first undercoat layer in an amount of 5.5 ml/m$^2$ and dried at 125° C. for 30 seconds, and 170° C. for 30 seconds.

| | |
|---|---|
| Deionized gelatin ($Ca^{2+}$content; 0.6 ppm, jelly strength; 230 g) | 10.0 g |
| Acetic acid (20% aqueous solution) | 0.0 g |
| Compound Bc-A | 0.04 g |
| Methylcellulose (2% aqueous solution) | 25.0 g |
| Emalex 710 (produced by Nihon Emulsion Co.) | 0.3 g |
| Distilled water | Amount giving total weight of 1000 g |

(2-3) First Back Layer

The surface of the support opposite to the surface coated with the undercoat layers was subjected to a corona discharge treatment of 0.375 kVA·minute/m$^2$, coated with a coating solution having the following composition in an amount of 13.8 ml/m$^2$, and dried at 125° C. for 30 seconds, 150° C. for 30 seconds, and 185° C. for 30 seconds.

| | |
|---|---|
| Julimer ET-410 (30% aqueous dispersion Nihon Junyaku Co., Ltd.) | 23.0 g |
| Alkali-treated gelatin (molecular weight; about 10000, $Ca^{2+}$ content; 30 ppm) | 4.44 g |
| Deionized gelatin ($Ca^{2+}$ content; 0.6 ppm) | 0.84 g |
| Compound Bc-A | 0.02 g |
| Dye Bc-A | Amount giving optical density of 1.3–1.4 at 783 nm, about 0.88 g |
| Polyoxyethylene phenyl ether | 1.7 g |
| Sumitex Resin M-3 (8% aqueous solution, water-soluble melamine compound, Sumitomo Chemical Co., Ltd.) | 15.0 g |
| FS-10D (aqueous dispersion of Sb-doped $SbO_2$ acicular grains, Ishihara Sangyo Kaisha, Ltd.) | 24.0 g |
| Polystyrene microparticles (mean diameter; 2.0 μm, variation coefficient of 7% for mean particle diameter) | 0.03 g |
| Distilled water | Amount giving total weight of 1000 g |

(2-4) Second Back Layer

A coating solution having the following composition was coated on the first back layer in an amount of 5.5 ml/m$^2$ and dried at 125° C. for 30 seconds, 150° C. for 30 seconds, and 170° C. for 30 seconds.

| | |
|---|---|
| Julimer ET-410 (30% aqueous dispersion Nihon Junyaku Co., Ltd.) | 57.5 g |
| Polyoxyethylene phenyl ether | 1.7 g |
| Sumitex Resin M-3 (8% aqueous solution, water-soluble melamine compound, Sumitomo Chemical Co., Ltd.) | 15.0 g |
| Cellosol 524 (30% aqueous solution, Chukyo Yushi Co., Ltd.) | 6.6 g |
| Distilled water | Amount giving total weight of 1000 g |

(2-5) Third Back Layer

The same coating solution as the first undercoat layer was coated on the second back layer in an amount of 6.2 ml/m$^2$ and dried at 125° C. for 30 seconds, 150° C. for 30 seconds, and 185° C. for 30 seconds.

(2-6) Fourth Back Layer

A coating solution having the following composition was coated on the third back layer in an amount of 13.8 ml/m$^2$ and dried at 125° C. for 30 seconds, 150° C. for 30 seconds, and 170° C. for 30 seconds.

| | |
|---|---|
| Latex B | 286 g |
| Compound Bc-B | 2.7 g |
| Compound Bc-C | 0.6 g |
| Compound Bc-D | 0.5 g |

-continued

| | |
|---|---|
| 2,4-Dichloro-6-hydroxy-s-triazine | 2.5 g |
| Polymethyl methacrylate (10% aqueous dispersion, mean particle diameter: 5.0 μm, variation coefficient of 7% for mean particle diameter) | 7.7 g |
| Distilled water | Amount giving total weight of 1000 g |

Dye Bc-A

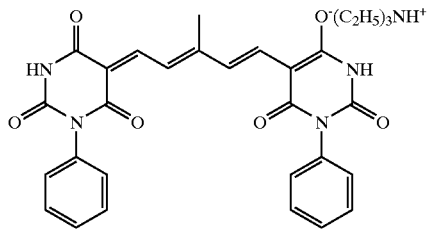

Compound Bc-A

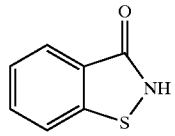

Compound Bc-B $C_{18}F_{37}OSO_3Na$

Compound Bc-C $C_8F_{17}SO_3Li$

Compound Bc-D $C_8F_{17}SO_2-N(C_4H_9)-(CH_2CH_2O)_4-(CH_2)_4-SO_3Na$

Latex A

Core/shell type latex comprising 90 weight % of core and 10 weight % of shell, core: vinylidene chloride/methyl acrylate/methyl methacrylate/acrylonitrile/acrylic acid=93/3/3/0.9/0.1 (weight %) shell: vinylidene chloride/methyl acrylate/methyl methacrylate/acrylonitrile/acrylic acid=88/3/3/3/3 (weight %), weight average molecular weight; 38000

Latex B

Latex of copolymer of methyl methacrylate/styrene/2-ethylhexyl acrylate/2-hydroxyethyl methacrylate/acrylic acid=59/9/26/5/1 (weight %)

(3) Heat Treatment During Transportation

The PET support with back layers and undercoat layers prepared as described above was introduced into a heat treatment zone having a total length of 200 m set at 160° C., and heat-treated by transporting it at a tension of 2 kg/cm$^2$ and a transportation speed of 20 m/minute.

Following the above heat treatment, the support was subjected to a post-heat treatment by passing it through a zone at 40° C. for 15 seconds, and rolled up. The rolling up tension for this operation was 10 kg/cm$^2$.

<<Preparation of Photothermographic Materials>>

On the undercoat layers of the aforementioned PET support on the side coated with the first and second undercoat layers, the aforementioned coating solution for image-forming layer was coated so that the coated silver amount could become 1.5 g/m$^2$ by the slide bead method disclosed in Japanese Patent Application No. 10-292849, FIG. 1. On the image-forming layer, the aforementioned coating solution for lower protective layer was coated simultaneously with the coating solution for image-forming layer as stacked layers so that the coated solid content of the polymer latex could become 1.31 g/m$^2$. Then, the coating solution for upper protective layer was coated thereon so that the coated solid content of the polymer latex could become 3.11 g/mz to prepare each photothermographic material.

After the coating, the layers were dried in a horizontal drying zone (the support was at an angle of 1.5–3° to the horizontal direction of the coating machine) under the following conditions: dry-bulb temperature of 70–75° C., dew point of 8–25° C. and liquid film surface temperature of 35–40° C. for both of the constant rate drying process and the decreasing rate drying process. After the drying, the material was rolled up under the conditions of a temperature of 25±5° C. and relative humidity of 45±10%, and the material was rolled up in such a rolled shape that the image-forming layer side should be exposed to the outside so as to conform to the subsequent processing (image-forming layer outside roll). The humidity in the package of the photothermographic material was 20–40% of relative humidity (measured at 25° C.). Each obtained photothermographic material showed a film surface pH of 5.0 and Beck's smoothness of 850 seconds for the image-forming layer side. The opposite surface showed a film surface pH of 5.9 and Beck's smoothness of 560 seconds.

<<Evaluation of Photographic Performance>>

(Light exposure)

The obtained photothermographic material was light exposed for $1.1\times10^{-8}$ second at a mirror revolution number of 64000 rpm by using a laser light-exposure apparatus of single channel cylindrical internal surface scanning type provided with a semiconductor laser with a beam diameter (½ of FwHM of beam intensity) of 12.56 $\mu$m, laser output of 50 mW and output wavelength of 783 nm. The overlap coefficient of the light exposure was 0.449.

(Heat Development)

Each light-exposed photothermographic material was heat-developed by using such a heat development apparatus as shown in FIG. 1. The roller surface material of the heat development section was composed of silicone rubber, and the flat surface consisted of Teflon non-woven fabric. The heat development was performed at a transportation line speed of 150 cm/minute. The heat development treatment was performed in the preheating section for 12.2 seconds (Driving units of the preheating section and the heat development section were independent from each other, and speed difference as to the heat development section was adjusted to −0.5% to −1%. Temperatures of the metallic rollers and processing times for each preheating part were as follows; first roller, 67° C. for 2.0 seconds; second roller, 82° C. for 2.0 seconds; third roller, 98° C. for 2.0 seconds; fourth roller, 107° C. for 2.0 seconds; fifth roller, 115° C. for 2.0 seconds; and sixth roller, 120° C. for 2.0 seconds), in the heat development section at 120° C. (surface temperature of photothermographic material) for 17.2 seconds, and in the gradual cooling section for 13.6 seconds. The treatment time in this operation varied depending on the line speed. The temperature precision as for the transverse direction was ±0.5° C. As for each roller temperature setting, the temperature precision was secured by using a length of rollers longer than the width of the photothermographic material (for example, width of 61 cm) by 5 cm for the both sides and also heating the protruding portions. Since the rollers showed marked temperature decrease at the both end portions, the temperature of the portions protruding by 5 cm from the end of the photothermographic material was controlled to be higher than that of the roller center by 1–3° C., so that uniform image density of finished developed image could be obtained for the whole photothermographic material surface (for example, within a width of 61 cm).

(Evaluation of Photographic Performance)

The obtained image was evaluated by using Macbeth TD904 densitometer (visible density). The results of the measurement were evaluated as Dmin (fog) and sensitivity (Sensitivity was evaluated as a reciprocal of the ratio of exposure giving a density 1.5 higher than Dmin, and expressed as a relative value based on the value of photothermographic material 1 shown in Table 1, which was taken as 100. The laser energy density at the surface of the photothermographic material was 150 $\mu$J/cm$^2$.). Further, as evaluation of storability, each photothermographic material after coating was left at 50° C. and relative humidity of 75% for 3 days, and then Dmin and sensitivity were evaluated.

The results of the above evaluations for each photothermographic material are shown in Table 1.

TABLE 1

| | Sensitizing dye | | | | | | | Immediately after coating | | After storage at 50° C. and 75% RH for 3 days after coating | | |
|---|---|---|---|---|---|---|---|---|---|---|---|---|
| Sample | Type | amount ($\times10^{-6}$ mole) | λmax (nm) | (1) | (2) | (3) | (4) | Dmin | Relative sensitivity | Dmin | Relative sensitivity | Note |
| 1 | R-1 | 5.7 | 780 | 1.4 | 2.5 | 1.1 | 1.3 | 0.12 | 100 | 0.6 | 0 | Comparative |
| 2 | R-2 | 5.7 | 785 | 1.3 | 2.5 | 1.4 | 1.9 | 0.11 | 150 | 0.54 | 10 | Comparative |
| 3 | I-7 | 5.7 | 790 | 2.8 | 44.2 | 2 | 4.7 | 0.11 | 400 | 0.12 | 90 | Invention |
| 4 | I-11 | 4.3 | 760 | 2 | 6.7 | 2.4 | 10 | 0.11 | 250 | 0.12 | 95 | Invention |
| 5 | I-11 | 5.7 | 760 | 2.1 | 7.2 | 2.4 | 8.8 | 0.11 | 360 | 0.13 | 95 | Invention |
| 6 | I-18 | 4.3 | 790 | 2.1 | 19.5 | 2.3 | 29.4 | 0.11 | 5500 | 0.12 | 98 | Invention |
| 7 | I-18 | 5.7 | 790 | 2.3 | 21 | 2.1 | 21.2 | 0.11 | 5300 | 0.13 | 100 | Invention |
| 8 | I-21 | 5.7 | 755 | 2.1 | 151 | 2.5 | 55.5 | 0.11 | 110 | 0.12 | 85 | Invention |

Addition amount: addition amount per 1 m$^2$ of surface area of silver halide grains (1) S(λmax)/S(λmax + 30 nm)

(2) S(λmax)/S(λmax − 30 nm)

(3) Abs.(λmax)/Abs.(λmax + 30 nm)

(4) Abs.(λmax)/Abs.(λmax − 30 nm)

TABLE 1-continued

| | Sensitizing dye | | | | | | | Immediately after coating | | After storage at 50° C. and 75% RH for 3 days after coating | | |
|---|---|---|---|---|---|---|---|---|---|---|---|---|
| Sample | Type | amount ($\times 10^{-6}$ mole) | λmax (nm) | (1) | (2) | (3) | (4) | Dmin | Relative sensitivity | Dmin | Relative sensitivity | Note |
| R-1 | 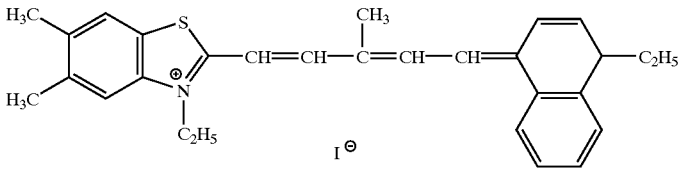 | | | | | | | | | | | |
| R-2 | 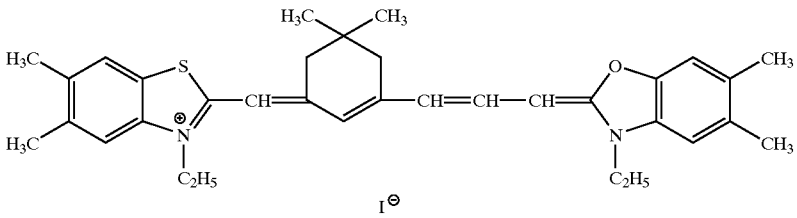 | | | | | | | | | | | |

From the results shown in Table 1, it can be seen that the photothermographic materials subjected to spectral sensitization using the sensitizing dyes of the present invention showed low fog (Dmin), high sensitivity and good storability. Thus, the advantages of the present invention were clearly demonstrated.

Example 2

<<Preparation of Photothermographic Material>>

Each of the coating solutions for image-forming layer and the coating solution for lower protective layer mentioned in Example 1 were simultaneously coated as stacked layers in the same manner as in Example 1. Then, the following coating solutions for two kinds of protective layers, i.e., the coating solution for intermediate protective layer and the coating solution for uppermost protective layer, were simultaneously coated as stacked layers so that the coated amount of polymer latex solid content in the intermediate protective layer could become 197 g/m$^2$ and the coated amount of polymer latex solid content in the uppermost protective layer should become 1.07 g/m$^2$ to prepare a photothermographic material.

<<Preparation of Coating Solution for Intermediate Protective Layer>>

In an amount of 625 g of polymer latex solution containing copolymer of methyl methacrylate/styrene/2-ethylhexyl acrylate/2-hydroxyethyl methacrylate/acrylic acid=58.9/8,6/25.4/5.1/2 (weight %) (glass transition temperature of the copolymer: 46° C. (calculated value), solid content: 21.5 weight %, containing Compound A at a concentration of 100 ppm and further containing Compound D as a film-forming aid in an amount of 15 weight % relative to solid content of the latex so that the glass transition temperature of coating solution could become 24° C., mean particle diameter: 72 nm) was added with water, 0.23 g of Compound C, 0.13 g of Compound E, 12.1 g of Compound F, 2.75 g of Compound H and 11.5 g of polyvinyl alcohol (PVA-235, Kuraray Co., Ltd.) and further added with water to form a coating solution (containing 0.5 weight % of methanol solvent). After the completion, the coating solution was degassed at a pressure of 0.47 atm for 60 minutes. The coating solution showed pH of 2.6 and viscosity of 50 mPa·s at 25° C.

<<Preparation of Coating Solution for Uppermost Protective Layer>>

In an amount of 649 g of polymer latex solution containing copolymer of methyl methacrylate/styrene/2-ethylhexyl acrylate/2-hydroxyethyl methacrylate/acrylic acid=58.9/8.6/25.4/5.1/2 (weight %) (glass transition temperature of the copolymer: 46° C. (calculated value), solid content: 21.5 weight %, containing Compound A at a concentration of 100 ppm and further containing Compound D as a film-forming aid in an amount of 15 weight % relative to solid content of the latex so that the glass transition temperature of coating solution could become 24° C., mean particle diameter; 116 nm) was added with water, 0.23 g of Compound C, 1.85 g of Compound E, 1.0 g of Compound G, 18.4 g of 30 weight % solution of carnauba wax (Cellosol 524, Chukyo Yushi Co., Ltd., silicone content: less than 5 ppm), 3.45 g of matting agent (polystyrene particles, mean diameter: 7 μm, variation coefficient for mean particle diamter: 8%) and 26.5 g of polyvinyl alcohol (PVA-235, Kuraray Co., Ltd.) and further added with water to form a coating solution (containing 3 weight % of methanol solvent). After the completion, the coating solution was degassed at a pressure of 0.47 atm for 60 minutes. The coating solution showed pH of 5.2 and viscosity of 24 mPa·s at 25° C.

The obtained photothermographic materials were evaluated in the same manner as in Example 1. As a result, the results of Example 1 were substantially reproduced. That is, the photothermographic materials subjected to spectral sensitization using the sensitizing dyes of the present invention showed low fog (Dmin), high sensitivity and good storability. Thus, the advantages of the present invention were clearly demonstrated.

Example 3

The same samples as used in Example 1 were exposed by using a cylinder external surface scanning type multichannel exposure apparatus (provided with 30 of 50 mW semiconductor laser heads), and subjected to heat development in the same manner as in Example 1. As a result, the photothermographic materials subjected to spectral sensitization using the sensitizing dyes of the present invention showed low fog (Dmin), high sensitivity and good storability. Thus, the advantages of the present invention were clearly demonstrated.

What is claimed is:

1. A photothermographic material containing a non-photosensitive silver salt and a photosensitive silver halide on a support, wherein the photosensitive silver halide is spectrally sensitized with a spectral sensitizing dye represented by the following formula (I) so that maximum spectral sensitivity wavelength is capable of becoming longer than 730 nm and the conditions defined by the following formulas (1) and (2) and/or the conditions defined by the following formulas (3) and (4) is capable of being satisfied:

$$300 \geqq S(\lambda\ \max)/S(\lambda\ \max+30\ nm) \geqq 4.5 \qquad \text{Formula (1)}$$

$$30 \geqq S(\lambda\ \max)/S(\lambda\ \max-30\ nm) \geqq 2 \qquad \text{Formula (2)}$$

$$300 \geqq Abs.(\lambda\ \max)/Abs.(\lambda\ \max+30\ nm) \geqq 4.5 \qquad \text{Formula (3)}$$

$$30 \geqq Abs.(\lambda\ \max)/Abs.(\lambda\ \max-30\ nm) \geqq 2 \qquad \text{Formula (4)}$$

wherein, in the above formulas, λmax denotes maximum spectral sensitivity wavelength, S(λmax) denotes spectral sensitivity at a wavelength of λmax and Abs. (λmax) denotes optical density at a wavelength of λmax, Formula (I)

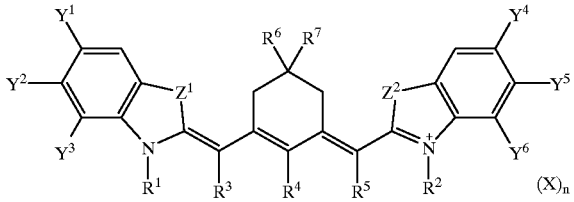

wherein $Z^1$ and $Z^2$ may be the same or different from each other, and they represent sulfur atom or selenium atom; $Y^1$ and $Y^4$ represent hydrogen atom, and $Y^1$, when $Y^2$ is not hydrogen atom and $Y^4$, when $Y^5$ is not hydrogen atom, also represent methyl group, ethyl group, hydroxy group or methoxy group; $Y^2$ and $Y^5$ represent hydrogen atom, an alkyl group having 3 or less carbon atoms, which may be substituted, hydroxy group, methoxy group, ethoxy group, a monocyclic aryl group, acetylamino group or propionylamino group; $Y^2$ and $Y^1$ or $Y^5$ and $Y^4$ may be bonded together to form methylenedioxy group, trimethylene group or tetramethylene group; $Y^3$ and $Y^6$ represent hydrogen atom, or $Y^3$ and $Y^2$ or $Y^6$ and $Y^5$ may be bonded together to form methylenedioxy group, ethylenedioxy group, trimethylene group, tetramethylene group or tetradehydrotetramethylene group; $R^1$ and $R^2$ may be the same or different from each other, and they represent an alkyl group or alkenyl group having 10 or less carbon atoms in total, which may be substituted; $R^3$ and $R^5$ represent hydrogen atom, or $R^3$ and $R^1$ or $R^5$ and $R^2$ may be bonded together to form a 5- or 6-membered ring; $R^4$ represents hydrogen atom or a lower alkyl group which may be substituted; $R^6$ represents hydrogen atom, methyl group, ethyl group or propyl group; $R^7$ represents a lower alkyl group which may be substituted, or phenyl group which may be substituted; X represents a counter ion required for neutralizing the electric charge; n represents 0 or 1; and when the compound forms an intramolecular salt, n is 0.

2. A photothermographic material according to claim 1, wherein the conditions defined by the formulas (1) and (2) are satisfied.

3. A photothermographic material according to claim 2, wherein the following formula is satisfied:

$$200 \geqq S(\lambda\ \max)/S(\lambda\ \max+30\ nm) \geqq 5.$$

4. A photothermographic material according to claim 3, wherein the following formula is satisfied:

$$200 \geqq S(\lambda\ \max)/S(\lambda\ \max+30\ nm) \geqq 10.$$

5. A photothermographic material according to claim 2, wherein the following formula is satisfied:

$$20 \geqq S(\lambda\ \max)/S(\lambda\ \max-30\ nm) \geqq 2.$$

6. A photothermographic material according to claim 5, wherein the following formula is satisfied:

$$10 \geqq S(\lambda\ \max)/S(\lambda\ \max-30\ nm) \geqq 2.$$

7. A photothermographic material according to claim 1, wherein the conditions defined by the formulas (3) and (4) are satisfied.

8. A photothermographic material according to claim 7, wherein the following formula is satisfied:

$$200 \geqq Abs.(\lambda\ \max)/Abs.(\lambda\ \max+30\ nm) \geqq 5.$$

9. A photothermographic material according to claim 8, wherein the following formula is satisfied:

$$200 \geqq Abs.(\lambda\ \max)/Abs.(\lambda\ \max+30nm) \geqq 10.$$

10. A photothermographic material according to claim 7, wherein the following formula is satisfied:

$$20 \geqq Abs.(\lambda\ \max)/Abs.(\lambda\ \max-30\ nm) \geqq 2.$$

11. A photothermographic material according to claim 10, wherein the following formula is satisfied:

$$10 \geqq Abs.(\lambda\ \max)/Abs.(\lambda\ \max-30\ nm) \geqq 2.$$

12. A photothermographic material according to claim 1, wherein the spectral sensitizing dye is used in an amount of $1\times10^{-7}$ mole to $1\times10^{-2}$ mole per 1 $m^2$ of surface area of the silver halide grains.

13. A photothermographic material according to claim 12, wherein the spectral sensitizing dye is used in an amount of $5\times10^{-7}$ to $7\times10^{-4}$ mole per 1 $m^2$ of surface area of the silver halide grains.

14. A photothermographic material according to claim 1, wherein the silver halide grains are riped with the spectral sensitizing dye at a temperature range of 40–90° C.

15. A photothermographic material according to claim 14, wherein the silver halide grains are riped with the spectral sensitizing dye at a temperature range of 50–80° C.

16. A photothermographic material according to claim 15, wherein the silver halide grains are riped with the spectral sensitizing dye at a temperature range of 60–70° C.

17. A photothermographic material according to claim 1, wherein the spectral sensitizing dye shows a polarographic half-wave reduction potential more negative than −1.26 V and a polarographic half-wave oxidation potential more positive than 0.38 V with respect to a saturated calomel electrode.

18. A photothermographic material according to claim 1, wherein, in the formula (I), at least one of $Z^1$ and $Z^2$ represents sulfur atom, $Y^1$ and $Y^4$ represent hydrogen atom, and $Y^2$ and $Y^5$ represent hydrogen atom, methyl group, ethyl group, propyl group, methoxymethyl group, hydroxyethyl group, hydroxy group, methoxy group, ethoxy group, phenyl group or acetylamino group, or $Y^2$ and $Y^3$ or $Y^5$ and $Y^6$ together represent methylenedioxy group, tetramethylene group or tetradehydrotetramethylene group, and $R^6$ represents hydrogen atom.

19. A photothermographic material according to claim 1, wherein the sensitizing dye is used with a compound represented by the general formula (II) or (III):

Formula (II)

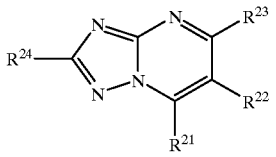

Formula (III)

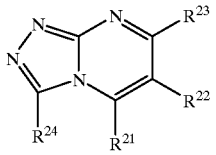

wherein $R^{21}$, $R^{22}$, $R^{23}$ and $R^{24}$ may be the same or different from one another, and each represent hydrogen atom, a substituted or unsubstituted alkyl group having 1–20 carbon atoms in total, which may be a cyclic or branched alkyl group, a substituted or unsubstituted monocyclic or bicyclic aryl group, a substituted or unsubstituted amino group, hydroxy group, an alkoxy group having 1–20 carbon atoms in total, an alkylthio group having 1–6 carbon atoms in total, a carbamoyl group which may be substituted with an aliphatic group or an aromatic group, a halogen atom, cyano group, carboxy group, an alkoxycarbonyl group having 2–20 carbon atoms in total, or a heterocyclic residue containing a 5- or 6-membered ring having one or more hetero atoms; $R^{21}$ and $R^{22}$ or $R^{22}$ and $R^{23}$ may be bonded together to form a 5- or 6-membered ring; with the proviso that at least one of $R^{21}$ and $R^{23}$ represents hydroxy group.

20. A photothermographic material according to claim 1, wherein the amount of photosensitive silver halide per mole of silver salt of an organic acid is 0.01–0.5 mole and wherein the nonphotosensitive silver salt is a silver salt of an organic acid.

21. A photothermographic material according to claim 1, wherein the amount of photosensitive silver halide per mole of silver salt of an organic acid is 0.03–0.25 mole and wherein the nonphotosensitive silver salt is a silver salt of an organic acid.

22. A photothermographic material according to claim 19, wherein at least one of $R^{21}$, $R^{22}$, $R^{23}$ and $R^{24}$ is a heterocyclic residue containing a 5- or 6-membered ring having one or more hetero atoms selected from nitrogen atom, oxygen atom, and sulfur atom.

* * * * *